US009665051B2

(12) United States Patent
Hikichi et al.

(10) Patent No.: US 9,665,051 B2
(45) Date of Patent: May 30, 2017

(54) IMAGE FORMING APPARATUS WITH DETACHABLE FIXING DEVICE, CONTROL METHOD THEREFOR, AND STORAGE MEDIUM STORING CONTROL PROGRAM THEREFOR

(71) Applicant: CANON KABUSHIKI KAISHA, Tokyo (JP)

(72) Inventors: Yukiyoshi Hikichi, Tokyo (JP); Yoshiro Tachibana, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/807,155

(22) Filed: Jul. 23, 2015

(65) Prior Publication Data

US 2016/0026138 A1 Jan. 28, 2016

(30) Foreign Application Priority Data

Jul. 28, 2014 (JP) ..... 2014-152912
Feb. 5, 2015 (JP) ..... 2015-021267

(51) Int. Cl.
*G03G 15/00* (2006.01)
*G03G 15/20* (2006.01)
*G03G 21/16* (2006.01)

(52) U.S. Cl.
CPC ..... *G03G 15/5091* (2013.01); *G03G 15/2017* (2013.01); *G03G 15/502* (2013.01); *G03G 21/16* (2013.01)

(58) Field of Classification Search
CPC ..... G03G 15/5091; G03G 15/5016; G03G 15/2017; G03G 15/502; G03G 21/16
USPC ..... 399/12, 13
See application file for complete search history.

(56) References Cited

U.S. PATENT DOCUMENTS 6,163,658 A 12/2000 Suzuki
8,611,775 B2 12/2013 Udagawa et al.
8,705,130 B2 4/2014 Miyazaki
(Continued)

FOREIGN PATENT DOCUMENTS

JP 109190138 A 7/1997
JP 2006330345 A 12/2006
(Continued)

OTHER PUBLICATIONS

Office Action issued in Japanese Application No. 2015-021267 mailed Sep. 6, 2016.

*Primary Examiner* — Billy Lactaoen
(74) *Attorney, Agent, or Firm* — Rossi, Kimms & McDowell LLP

(57) ABSTRACT

An image forming apparatus with a detachable fixing device capable of managing a plurality of detachable fixing devices appropriately according to usages etc. A receiving unit receives a character string input through an operation screen. A storage unit stores the input character string in association with identification information about a fixing device. An obtaining unit obtains the identification information about the fixing device attached to the image forming apparatus. A display control unit displays the character string that is stored by the storage unit in association with the identification information obtained by the obtaining unit on a display unit.

12 Claims, 22 Drawing Sheets

(56) References Cited

U.S. PATENT DOCUMENTS

| | | | | |
|---|---|---|---|---|
| 2013/0100467 | A1* | 4/2013 | Miyazaki | H04N 1/00015 358/1.9 |
| 2013/0343770 | A1* | 12/2013 | Hewitt | G03G 15/5016 399/12 |

FOREIGN PATENT DOCUMENTS

| | | | |
|---|---|---|---|
| JP | 2012098518 | A | 5/2012 |
| JP | 2013088683 | A | 5/2013 |

* cited by examiner

CASE WHERE
ENVELOPE-DEDICATED
FIXING DEVICE IS ATTACHED

CASE WHERE
A3/A4-DEDICATED FIXING
DEVICE IS ATTACHED

IMAGE FORMING APPARATUS WITH DETACHABLE FIXING DEVICE, CONTROL METHOD THEREFOR, AND STORAGE MEDIUM STORING CONTROL PROGRAM THEREFOR

BACKGROUND OF THE INVENTION

Field of the Invention

The present invention relates to an image forming apparatus, a control method therefor, and a storage medium storing a control program therefor, and in particular, relates to an image forming apparatus that uses a plurality of fixing devices by switching them according to a printing medium.

Description of the Related Art

In a field of production print, a large quantity of printing may be performed on special sheets other than plain paper using an image forming apparatus like a laser beam printer or a digital multifunctional peripheral device. Then, when printing on envelopes, an operator exchanges a normal fixing device used for printing on plain paper for an envelope-dedicated fixing device in order to prevent the fixing device from crinkling an envelope passed through, and starts printing.

An envelope-dedicated fixing device differs in materials of a pressure roller and a fixing belt and in fixing nip pressure from a normal fixing device. A normal fixing device is able to print on an envelope by changing fixing nip pressure and press speed. However, it is preferable to use an envelope-dedicated fixing device in order to print a large number of envelopes with higher quality at higher speed.

In production print, a large quantity of printing is often performed using a certain type of sheets. Accordingly, a large quantity of printing is performed using an envelope-dedicated fixing device in the case of printing on an envelope, and using a normal fixing device in place of the envelope-dedicated fixing device in the case of printing on another type of sheets. Furthermore, image processing parameters are changed according to the type of a fixing device with which the image forming apparatus is equipped. For example, there is a known method that stores gamma correction data used for adjusting density of a print image, the type of the fixing device at the time of generating image data, and the type of the sheet used in printing into a memory, and changes the image processing parameters at the time of printing (see Japanese Laid-Open Patent Publication (Kokai) No. 2013-088683 (JP 2013-088683A)).

Moreover, there is a known image forming apparatus that determines the type of a fixing device attached to the image forming apparatus by means of a photosensor etc., and displays a message, which shows that an envelope-dedicated fixing device is attached, on an operation screen when the determined type means the envelope-dedicated fixing device.

Furthermore, there is a known image forming apparatus that displays a warning message urging an operator to return the fixing mode to a normal mode after the last sheet is fixed in an envelope mode, when the current fixing mode is the envelope mode and the following image formation is not instructed, or when the sheet designated by the following image formation is not an envelope (see Japanese Laid-Open Patent Publication (Kokai) No. 2012-98518 (JP 2012-98518A)).

However, since the conventional image forming apparatus only determines whether the attached fixing device is a special fixing device (for example, an envelope-dedicated fixing device), it is difficult to manage a plurality of fixing devices of the same type. For example, even when a plurality of envelope-dedicated fixing devices are used for different uses, the message only shows that an envelope-dedicated fixing device is attached, which cannot support an operator.

Specifically, when an operator wants to use the fixing devices for different sizes of printing sheets or different size systems of sheets, a conventional image forming apparatus cannot attract operator's attention about the usage of an attached fixing device. As a result, the printout sheets that the operator wants may not be output.

SUMMARY OF THE INVENTION

The present invention provides an image forming apparatus, a control method therefor, and a storage medium storing a control program therefor, which are capable of managing a plurality of detachable fixing devices appropriately according to usages etc.

Accordingly, a first aspect of the present invention provides an image forming apparatus with a detachable fixing device, the image forming apparatus comprising a receiving unit configured to receive a character string input through an operation screen, a storage unit configured to store the input character string in association with identification information about a fixing device, an obtaining unit configured to obtain the identification information about the fixing device attached to the image forming apparatus, and a display control unit configured to display the character string that is stored by the storage unit in association with the identification information obtained by the obtaining unit on a display unit.

Accordingly, a second aspect of the present invention provides a control method for an image forming apparatus with detachable fixing device, the control method comprising a receiving step of receiving a character string input through an operation screen, a storing step of storing the input character string in association with identification information about a fixing device, an obtaining step of obtaining the identification information about the fixing device attached to the image forming apparatus, and a display control step of displaying the character string that is stored in the storing step in association with the identification information obtained in the obtaining step on a display unit.

Accordingly, a third aspect of the present invention provides a non-transitory computer-readable storage medium storing a control program causing a computer to execute the control method of the second aspect.

According to the present invention, since the message beforehand registered about each of the fixing devices is informed according to the identification information when exchange of the fixing device is detected, the plurality of detachable fixing devices are appropriately managed according to the usages etc.

Further features of the present invention will become apparent from the following description of exemplary embodiments with reference to the attached drawings.

DESCRIPTION OF THE EMBODIMENTS

Hereafter, an example of an image forming apparatus according to an embodiment of the present invention will be described with reference to the attached drawings.

Figure 1:
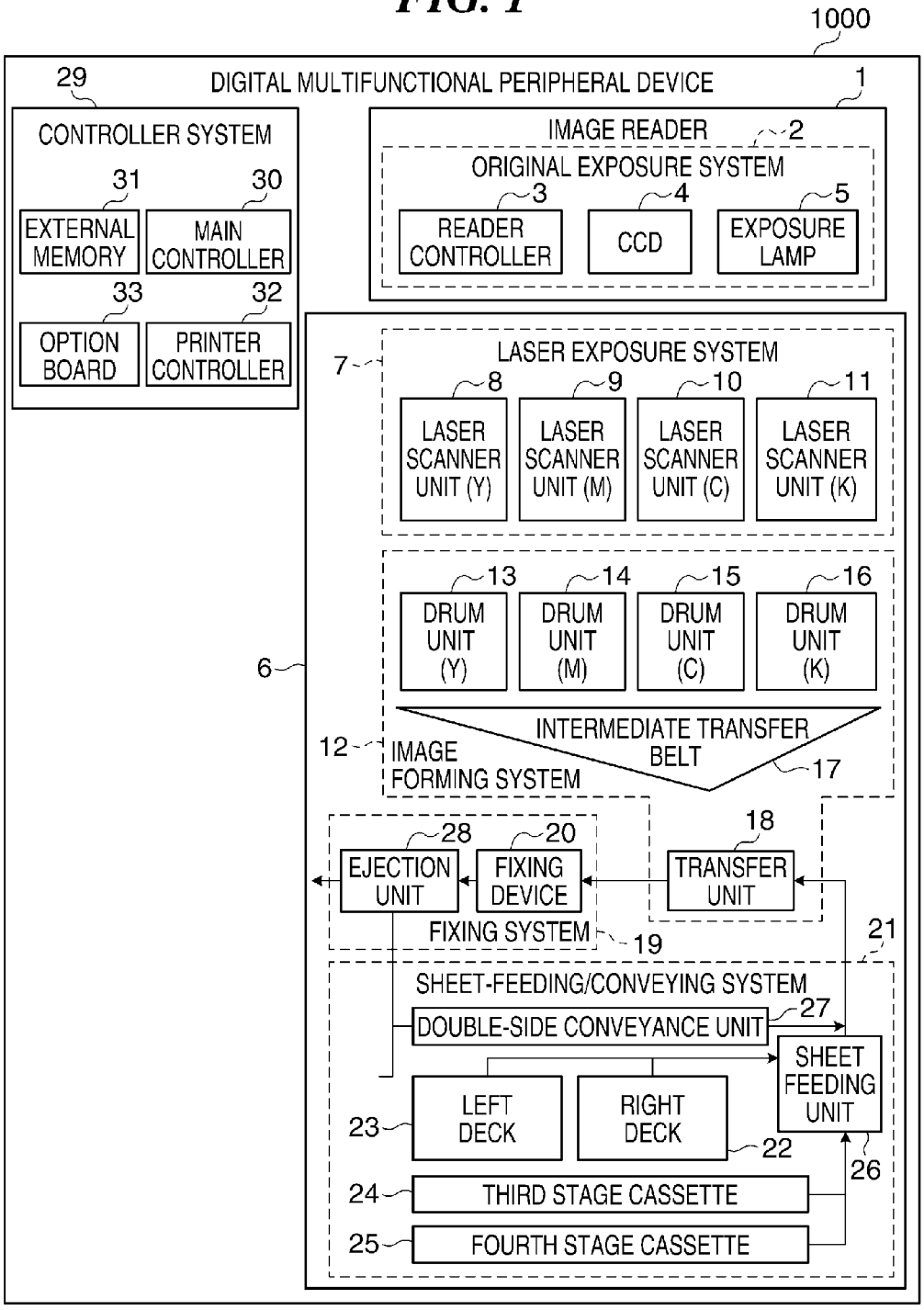
FIG. 1 is a block diagram schematically showing a configuration of an image forming apparatus (a multifunctional peripheral device) according to a first embodiment of the present invention.

FIG. 1 is a block diagram schematically showing a configuration of an image forming apparatus according to a first embodiment of the present invention.

The illustrated image forming apparatus is a digital multifunctional peripheral device (hereinafter referred to as a multifunctional peripheral device) 1000, and has an image reader 1 that reads a paper original, and a laser beam printer unit 6 that forms an image through an electrophotography process, for example.

The illustrated multifunctional peripheral device 1000 has six blocks including an original exposure system 2, a controller system 29, a laser exposure system 7, an image forming system 12, a fixing system 19, and a sheet-feeding/conveying system 21. Then, the image reader 1 is provided with the original exposure system 2. Moreover, the laser beam printer unit 6 consists of the laser exposure system 7, the image forming system 12, the fixing system 19, and the sheet-feeding/conveying system 21.

The controller system 29 is provided with a main controller 30 that has a CPU and a memory, an external memory 31, a printer controller 32, and an option board 33. The main controller 30 controls the whole multifunctional peripheral device according to programs stored in the external memory 31, such as a hard disk drive (HDD). The main controller 30 has a network function and is able to communicate with a host computer etc.

The printer controller 32 controls the laser beam printer unit 6 under the control of the main controller 30, and makes it output a printout (printed matter). Furthermore, the printer controller 32 controls option accessories to execute various option processes. It should be noted that a saddle stitching machine for executing a saddle stitch bookbinding process and a stacker for sorting printed matters may be employed as option accessories, for example. When these option accessories are used, the controller system 29 is provided with controllers applicable to the option accessories as the option board 33.

The original exposure system 2 is provided with a reader controller 3, a CCD image sensor 4, and an exposure lamp 5. The reader controller 3 turns the exposure lamp 5 ON, reads an image formed by reflected lights from an original by the CCD 4, and converts the output of the CCD 4 into digital data (image data). Then, this image data is transmitted to the main controller 30.

The laser exposure system 7 is provided with four laser scanner units 8 through 11 for four colors of Y (yellow), M (magenta), C (cyan), and K (black) in the laser beam printer unit 6. Then, these laser scanner units 8 through 11 scan photosensitive drums of drum units 13 through 16 in the image forming system 12 for Y, M, C, and K with laser beams to form electrostatic latent images of Y, M, C, and K on the photosensitive drums for the colors, respectively. It should be noted that each of the drum units 13 through 16 has a photosensitive drum and a development device. The development device for each color has a container that stores toner and carrier that applies an electric charge to the toner.

The above-mentioned image data (illustrating data) is transmitted to the laser exposure system 7 from the printer controller 32 as mentioned later. This image data may be PDL data that is received from a host computer (not shown) through a network besides the data obtained from the image reader 1 by reading an original as mentioned above, for example.

The four electrostatic latent images formed on the four photosensitive drums are respectively developed by the development devices to form toner images of the four colors (Y, M, C, and K). Subsequently, the four toner images are transferred to an intermediate transfer belt 17 from the four photosensitive drums, and a full-color toner image is formed on the intermediate transfer belt 17.

The sheet-feeding/conveying system 21 is provided with a right deck 22, a left deck 23, a third stage cassette 24, and a fourth stage cassette 25. Each of the right deck 22, the left deck 23, the third stage cassette 24, and the fourth stage cassette 25 is a sheet cassette for storing printing sheets. Here, printing sheets of comparatively small size are stored in the right deck 22 and left deck 23, and printing sheets of large size are stored in the third stage cassette 24 and fourth stage cassette 25. It should be noted that each of the right deck 22, the left deck 23, the third stage cassette 24, and the fourth stage cassette 25 is simply referred to as a sheet cassette in the following description.

The sheet feeding unit 26 conveys a printing sheet from a selected one of the sheet cassettes 22 through 25 to the image forming system 12. When the printing sheet is conveyed from the sheet-feeding/conveying system 21 to the transfer unit 18 of the image forming system 12, the full-color toner image on the intermediate transfer belt 17 is transferred to the printing sheet. Then, the printing sheet is conveyed to the fixing system 19. A fixing roller in a fixing device (fixing unit) 20 applies a thermal press bonding process to the printing sheet. As a result, the full-color toner image adheres to the printing sheet. In a case of double-side printing, a double-side conveyance unit 27 conveys the sheet that the image is printed on one side to the image forming system 12 again. Then, the printing sheet after printing is ejected outside the laser beam printer unit 6 by an ejection unit 28.

Figure 2:
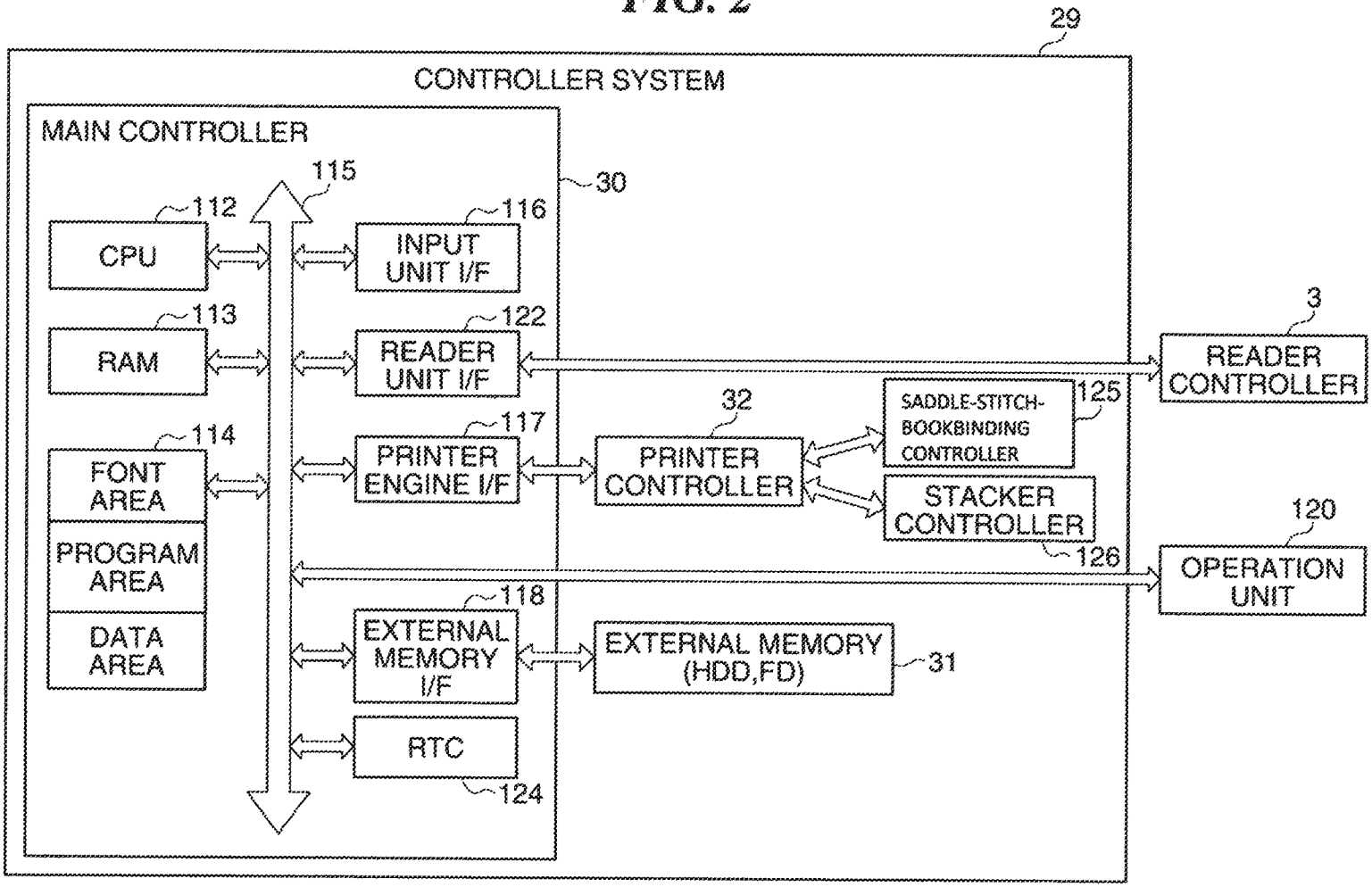
FIG. 2 is a block diagram schematically showing a hardware configuration of a controller system shown in FIG. 1.

FIG. 2 is a block diagram schematically showing a hardware configuration of the controller system 29 shown in FIG. 1.

As illustrated, the main controller 30 is provided with a CPU 112. The CPU 112 outputs image data to a printer engine interface (I/F) 117 connected to a system bus 115 on the basis of a control program. It should be noted that the control program is stored in the external memory 31 or a program area in a ROM 114.

A font area in the ROM 114 stores font data etc. that are used for generating image data. Moreover, a data area in the ROM 114 stores information (data) etc. that are used in the host computer when the external memory 31 does not exist.

The printer controller 32 forms an image on a printing sheet through the electrophotography process according to the image data transmitted through the printer engine I/F 117. When the saddle stitch bookbinding process or the sorting process of printed matters is performed, a saddle stitching machine or a stacker is attached to the multifunctional peripheral device 1000, and a saddle-stitch-bookbinding controller 125 or a stacker controller 126 is connected to the printer controller 32 as the option board 33 of the controller system 29. The CPU 112 receives the electronic data that is generated by reading a paper original from the reader controller 3 through a reader unit I/F 122.

The CPU 112 can communicate with a host computer through an input unit I/F 116. Then, the CPU 112 can notify the host computer of the variety of information about the multifunctional peripheral device. The RAM 113 is used as a main memory, a work area, etc. of the CPU 112, and the memory capacity can be extended by connecting an option RAM to an add-on port (not shown).

It should be noted that the RAM 113 is used as an output data development area, an environment data storing area, and an NVRAM. Moreover, the CPU 112 controls the access of the external memory 31 through an external memory I/F 118.

The external memory 31 is an option memory and font data, an emulation program, and form data are stored here, for example. It should be noted that a plurality of external memories 31 may be provided. That is, a plurality of external memories, such as an external memory that stores an option font in addition to a built-in font, and an external memory that stores a program for interpreting a printer control language of a different language system, may be provided. Furthermore, an NVRAM (not shown) may be provided as the external memory 31, and printer-mode setup information given from the operation unit 120 may be stored into the NVRAM concerned.

The operation unit 120 has switches that are operated through an operation panel, LED indicators, etc. A real time clock circuit (RTC) 124 is hardware that measures time and counts time at regular intervals. Since the RTC 124 operates by being supplied electric power from an internal battery, it continues to operate even when the main controller 30 stops. Then, the RTC 124 generates an interrupt signal at the predetermined time or predetermined time intervals according to a register value written in a resister of the RTC 124 from the CPU 112, and notifies the CPU 112 of the interruption.

Figure 3:
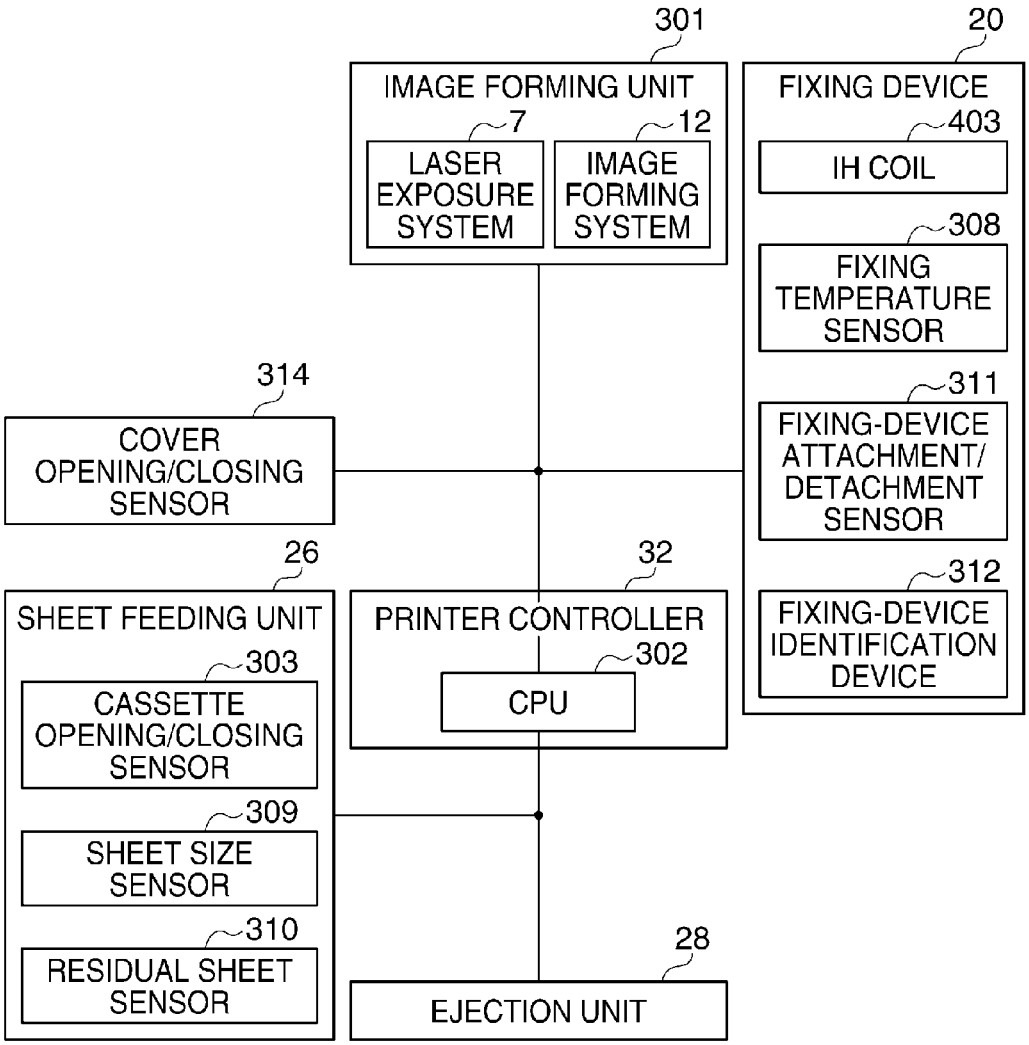
FIG. 3 is a block diagram schematically showing controls by a printer controller shown in FIG. 1.

FIG. 3 is a block diagram schematically showing controls by the printer controller 32 shown in FIG. 1.

The printer controller 32 is provided with a CPU 302. Then, the CPU 302 controls an image forming unit 301 that includes the laser exposure system 7 and the image forming system 12, the sheet feeding unit 26, the fixing device 20, and the ejection unit 28.

The sheet feeding unit 26 is provided with a cassette opening/closing sensor 303, a sheet size sensor 309, and a residual sheet sensor 310. The cassette opening/closing sensor 303 detects opening/closing of the sheet cassette (a sheet feeding stage). The sheet size sensor 309 detects a printing sheet size stored in the sheet cassette. The residual sheet sensor 310 detects the remaining amount of the printing sheets stored in the sheet cassette.

The fixing device 20 is provided with an IH (induction heating) coil 403 that functions as a heater, a fixing temperature sensor 308, a fixing-device attachment/detachment sensor 311, and a fixing-device identification device 312. When a magnetic flux that occurs when an alternating current of a high frequency is applied to the IH coil 403 passes metal, an eddy current flows in the metal concerned. This eddy current generates Joule's heat in the metal. The method of heating metal with this Joule's heat is called induction heating. The fixing temperature sensor 308 detects a fixing temperature. The fixing-device attachment/detachment sensor 311 detects detachment of the detachable fixing device. The fixing-device identifying device 312 is used for identifying the fixing device attached to the multifunctional peripheral device.

For example, the fixing-device attachment/detachment sensor 311 is a photo interrupter in which light is intercepted by a projection formed on a fixing-device base (not shown) when the fixing device is attached. As a result of this, the fixing-device attachment/detachment sensor 311 notifies the CPU 302 that the fixing device is attached at the predetermined position. The fixing-device identifying device 312 is a nonvolatile memory included in the fixing device. ID (identification information) that has been beforehand defined for each fixing device is written in this nonvolatile memory. The ID is an eight-digit serial number. First three alphabet characters indicate the type of fixing device and second five-digit numeral identifies a fixing device uniquely. When the fixing device attached to the multifunctional peripheral device is an envelope-dedicated fixing device, the first three characters of the ID are set to "ENV". Moreover, when the fixing device attached to the multifunctional peripheral device is a normal fixing device, the first three characters of the ID are set to "NOR".

The cover opening/closing sensor 314 detects opening/closing of covers of the multifunctional peripheral device. The CPU 302 is notified that a cover at a predetermined position is opened or closed.

Figure 4:
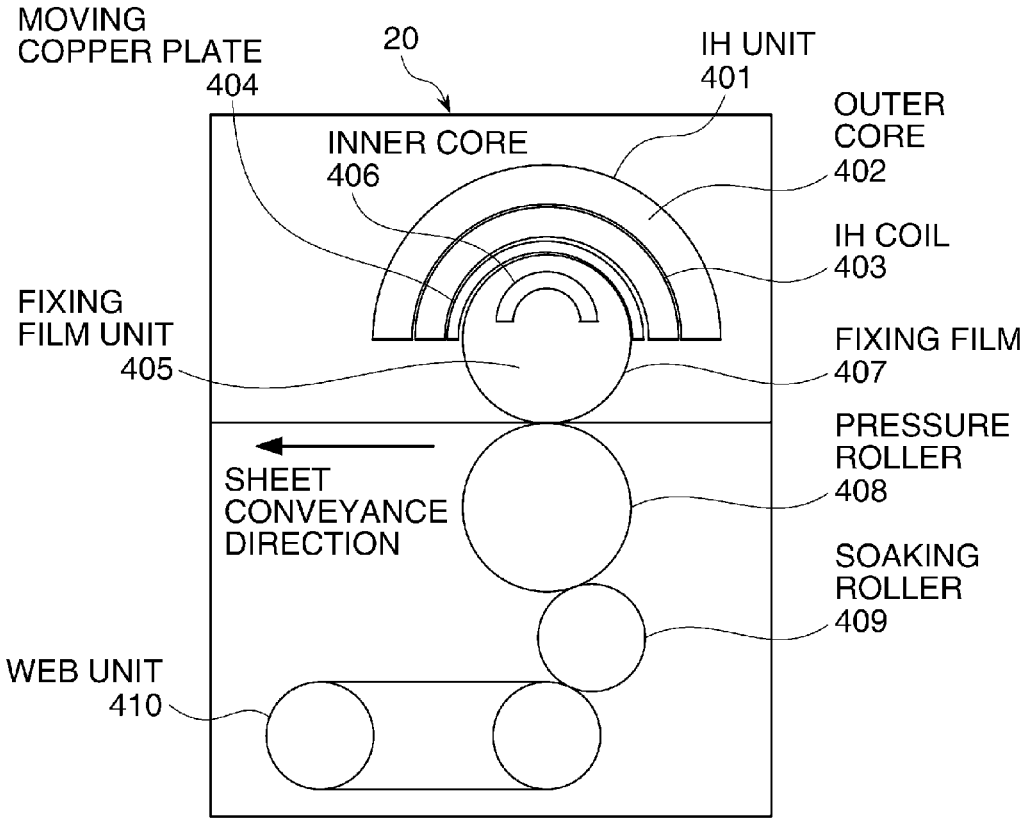
FIG. 4 is a view showing a configuration of a fixing device shown in FIG. 1.

FIG. 4 is a view showing the configuration of the fixing device 20 shown in FIG. 1.

The fixing device 20 is provided with an IH unit 401, a fixing film unit 405, a pressure roller 408, a soaking roller 409, and a web unit 410. The IH unit 401 has the IH coil 403, an outer core 402, and a moving copperplate 404.

The fixing film unit 405 is provided with a fixing film 407 that directly contacts to a printing sheet to fix toner to the printing sheet, and an inner core 406 arranged inside the fixing film 407. The fixing film 407 is configured by coating silicone rubber on metal.

The IH coil 403 makes the fixing film 407 self-heat by the IH. The outer core 402 and the inner core 406 raise heating efficiency of the fixing film 407. The moving copperplate 404 prevents excessive temperature rise of paper a no-passing portion at an end of the fixing film 407 in the longitudinal direction in a case where an image is printed on a printing sheet of a small size.

The pressure roller 408 applies pressure to a printing sheet from the downside to fix the toner firmly. Although the excessive temperature rise of the end of the fixing film 407 is prevented by the moving copperplate 404 as mentioned above, some heat remains. The soaking roller 409 reduces the temperature rise by releasing the heat of the end. The web unit 410 cleans this soaking roller 409 periodically.

Figure 5:
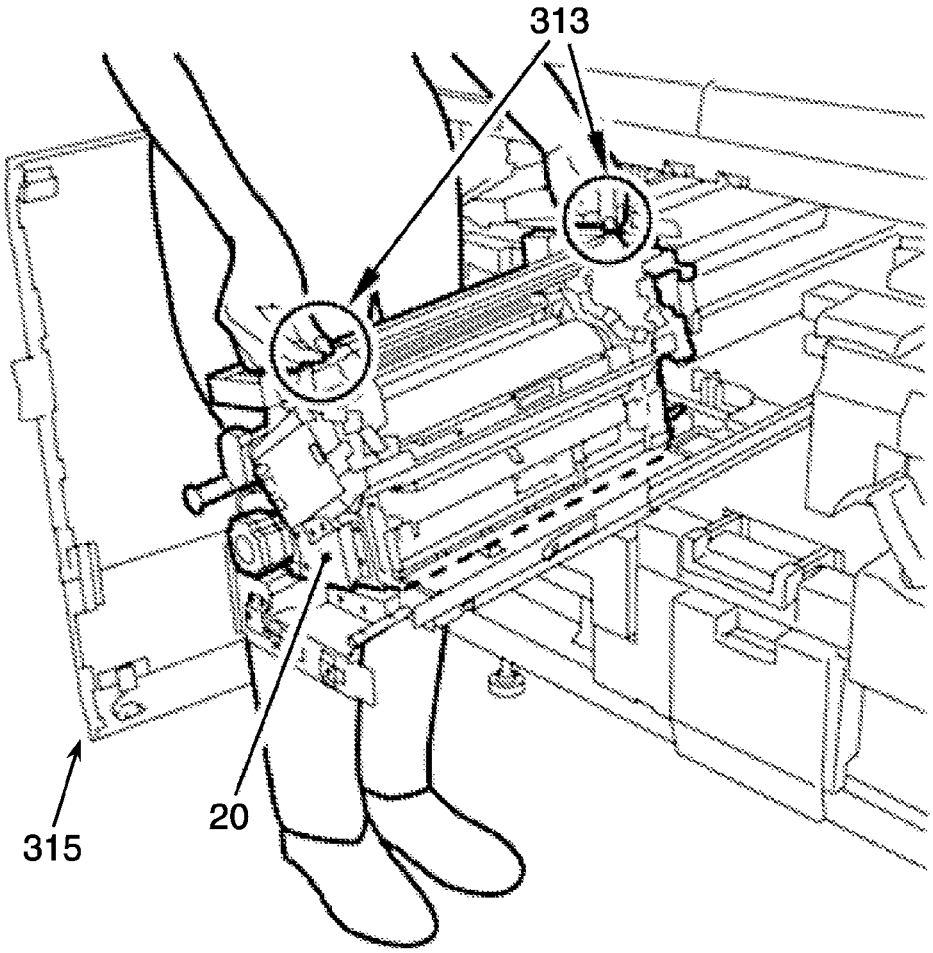
FIG. 5 is a perspective view showing the exchanging work of the fixing device in the multifunctional peripheral device shown in FIG. 1.

The fixing device 20 is detachable with respect to the multifunctional peripheral device shown in FIG. 1. FIG. 5 is a perspective view showing the exchanging work of the fixing device in the multifunctional peripheral device shown in FIG. 1.

When detaching the fixing device 20 from the multifunctional peripheral device, an operator holds attaching grips 313 formed at the both ends of the fixing device 20 with both hands, and detaches the fixing device. After attaching another fixing device 20 to the multifunctional peripheral device, the operator closes a body front cover 315, and the exchanging work of the fixing device is completed. Here, there are an envelope-dedicated fixing device used when printing envelopes and a normal fixing device used when printing sheets other than envelopes as fixing devices, for example. Then, the operator attaches one of the fixing devices to the multifunctional peripheral device and prints.

The envelope-dedicated fixing device has a different configuration from the normal fixing device in some respects. An envelope is formed by pasting a plurality of sheets of paper, and has a flap portion as a closing part. Accordingly, an envelope needs different consideration from a printing sheet other than an envelope. For example, the envelope-dedicated fixing device needs to thin down thicknesses of the pressure roller and the fixing film in order to hardly cause creases. Furthermore, the pressure by the pressure roller in the envelope-dedicated fixing device is different from that in the normal fixing device.

In this way, since the envelope-dedicated fixing device has the configuration specialized in an envelope, the use of the envelope-dedicated fixing device for printing sheets other than an envelope may cause an image defect and an operation failure of a fixing device.

The multifunctional peripheral device shown in FIG. 1 allows to register information (character strings), such as an individual name and a warning message to an operator, for each of the plurality of fixing devices. When the multifunctional peripheral device detects the attached fixing device, the information registered for the fixing device concerned is displayed on the screen of the operation unit 120, as mentioned below.

Figure 6A:
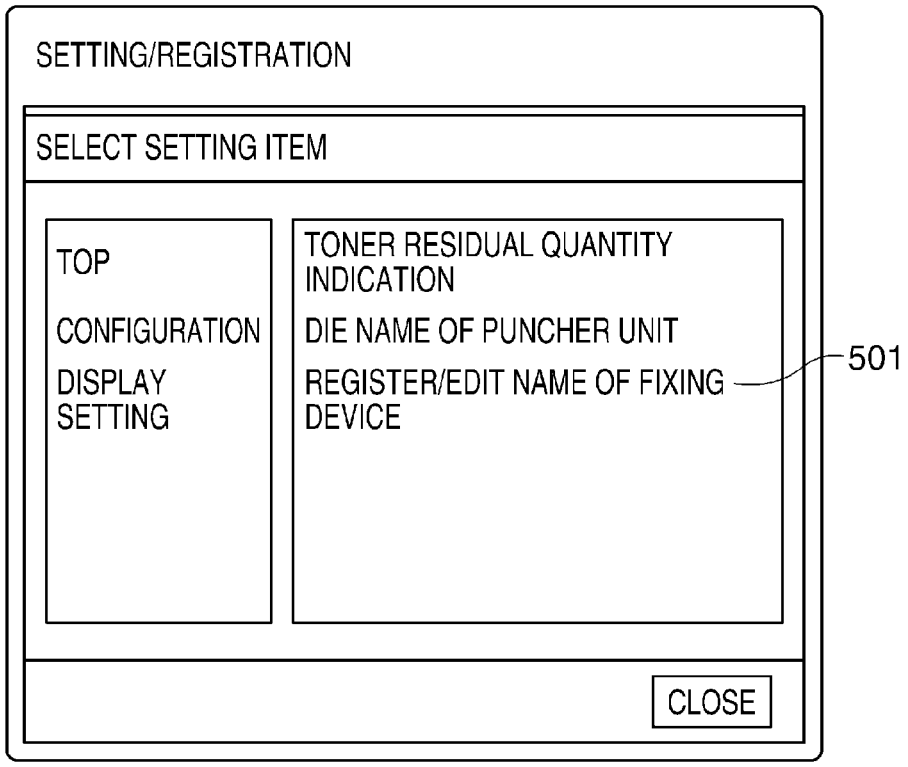
FIG. 6A is a view showing a setting/registration screen for a message concerning the fixing device displayed on an operation unit shown in FIG. 2.
Figure 6B:
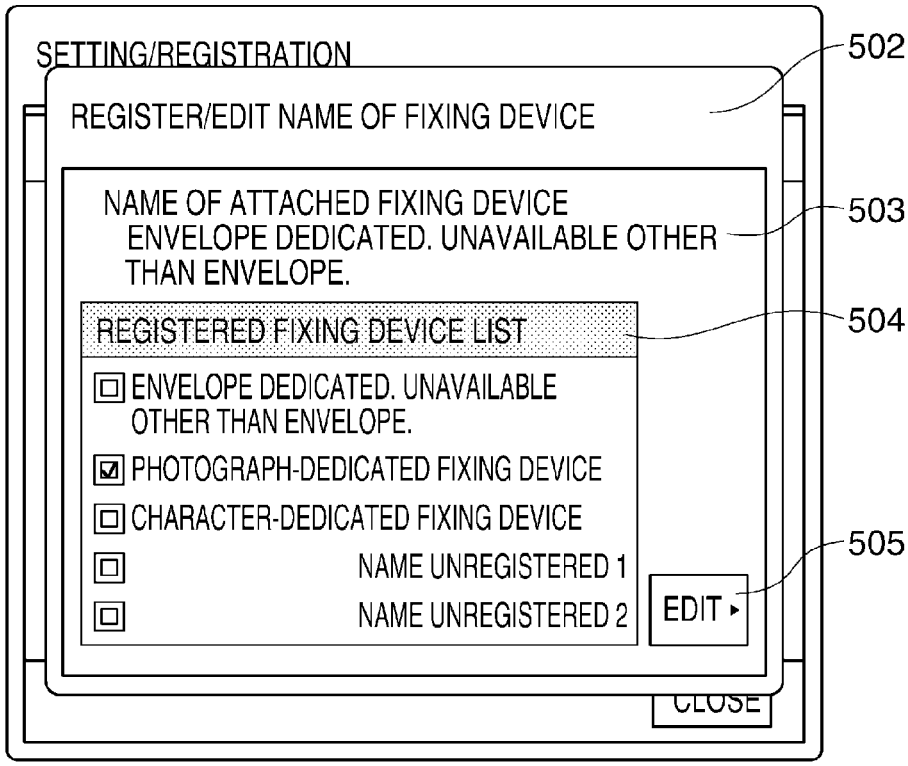
FIG. 6B is a view showing a fixing-device-name edit dialog displayed over the setting/registration screen in FIG. 6A.

FIG. 6A is a view showing a setting/registration screen for the information concerning the fixing device displayed on the operation unit 120 shown in FIG. 2. FIG. 6B is a view showing a fixing-device-name edit dialog displayed over the setting/registration screen in FIG. 6A.

An operator operates the operation unit 120 to display the setting/registration screen (FIG. 6A) on the operation unit 120. In the setting/registration screen, when a selection of a fixing-device-name registration/edit menu 501 is detected, the CPU 112 displays the fixing-device-name edit dialog 502 shown in FIG. 6B on the operation unit 120. FIG. 6B shows the state where the multifunctional peripheral device is equipped with the envelope-dedicated fixing device as a fixing device.

In the fixing-device-name edit dialog 502, the registered name of the envelope-dedicated fixing device is displayed in a name label area 503, and a registered fixing device list 504 is displayed. The names of the fixing devices stored by the multifunctional peripheral device are displayed in the registered fixing device list 504 concerned. For a fixing device of which a name is not registered, "NAME UNREGISTERED" is displayed.

It should be noted that the information (attribute data) about a fixing device, such as a name of a fixing device and a count number of sheets passed, may be stored in a nonvolatile memory provided in the multifunctional peripheral device or a flash memory attached to the fixing device.

A fixing-device-name edit button 505 displayed on the fixing-device-name edit dialog 502 is used for editing a name of a fixing device in the registered fixing device list. A name can be changed using a software keyboard (not shown) that will be displayed on the screen. Although the title is "NAME OF ATTACHED FIXING DEVICE", arbitrary character strings can be registered.

Figure 7A:
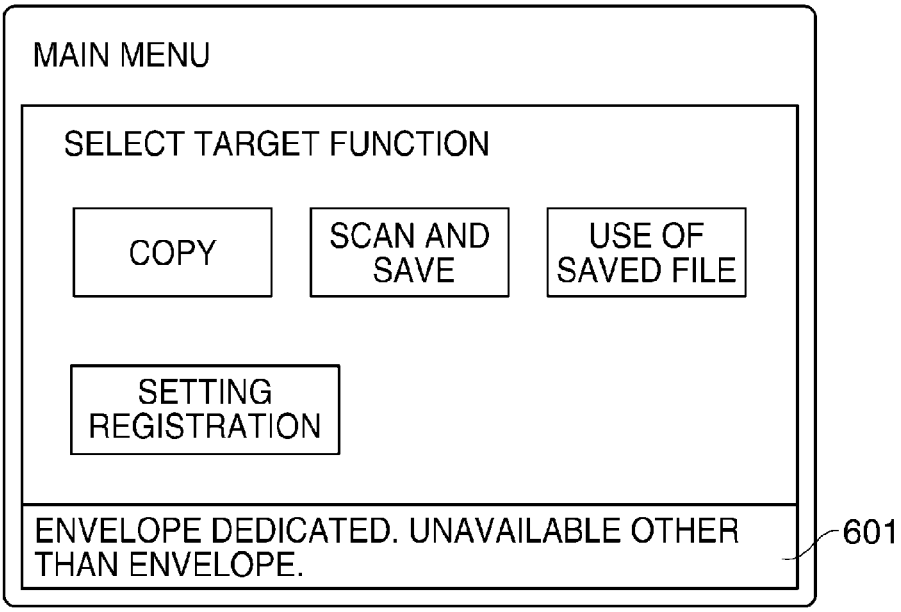
FIG. 7A is a view showing a main menu screen displayed on the operation unit shown in FIG. 2.
Figure 7B:
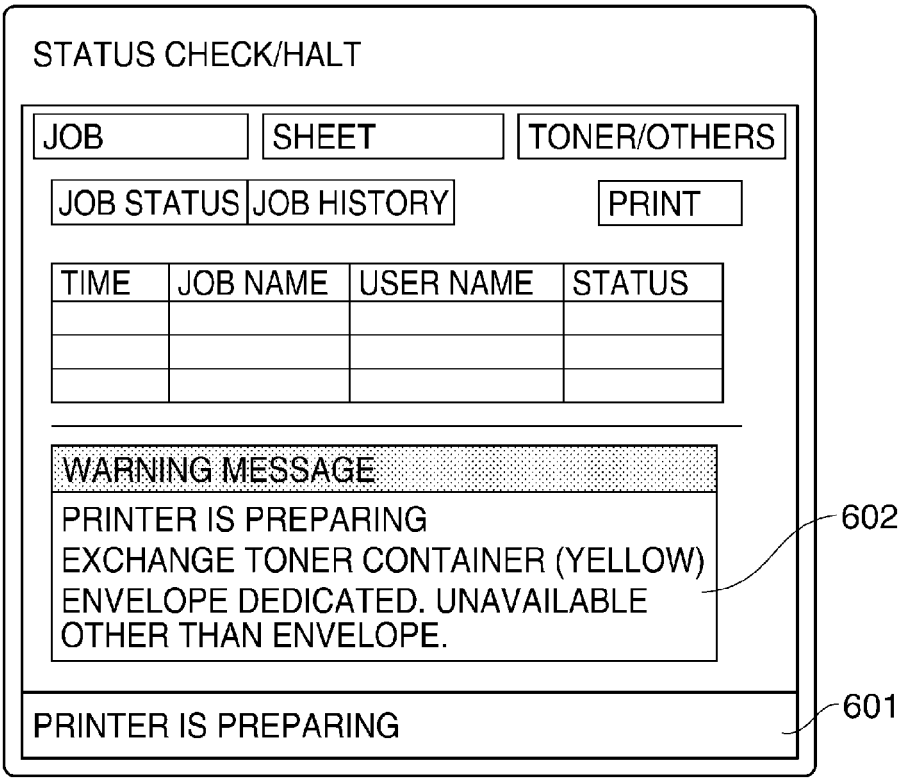
FIG. 7B is a view showing a status check/halt screen displayed on the operation unit shown in FIG. 2.

FIG. 7A is a view showing a main menu screen displayed on the operation unit 120 shown in FIG. 2. FIG. 7B is a view showing a status check/halt screen displayed on the operation unit 120 shown in FIG. 2.

When the power of the multifunctional peripheral device is turned ON and the multifunctional peripheral device is started, the CPU 112 displays the main menu screen, which is an initial screen, shown in FIG. 7A on the operation unit 120. It should be noted that the lowermost rows of the main menu screen and the status check/halt screen are reserved as status display areas 601.

The CPU 112 will display a message in the status display area 601, if a certain phenomenon which an operator should know occurs. For example, the CPU 112 displays that the printer is preparing as shown in FIG. 7B in the status display area 601. Moreover, the CPU 112 displays the message about the registered fixing device in the status display area 601 to notify the operator as shown in FIG. 7A.

Since the status display area 601 is a narrow area, the name of the fixing device may not be displayed when another message with a higher priority is displayed. In such a case, the message can be checked by looking the warning message list 602 in the status check/halt screen shown in FIG. 7B. When a status check/halt dedicated button (not shown) of the operation unit 120 is depressed, the CPU 112 displays the status check/halt screen on the operation unit 120.

Figure 8:
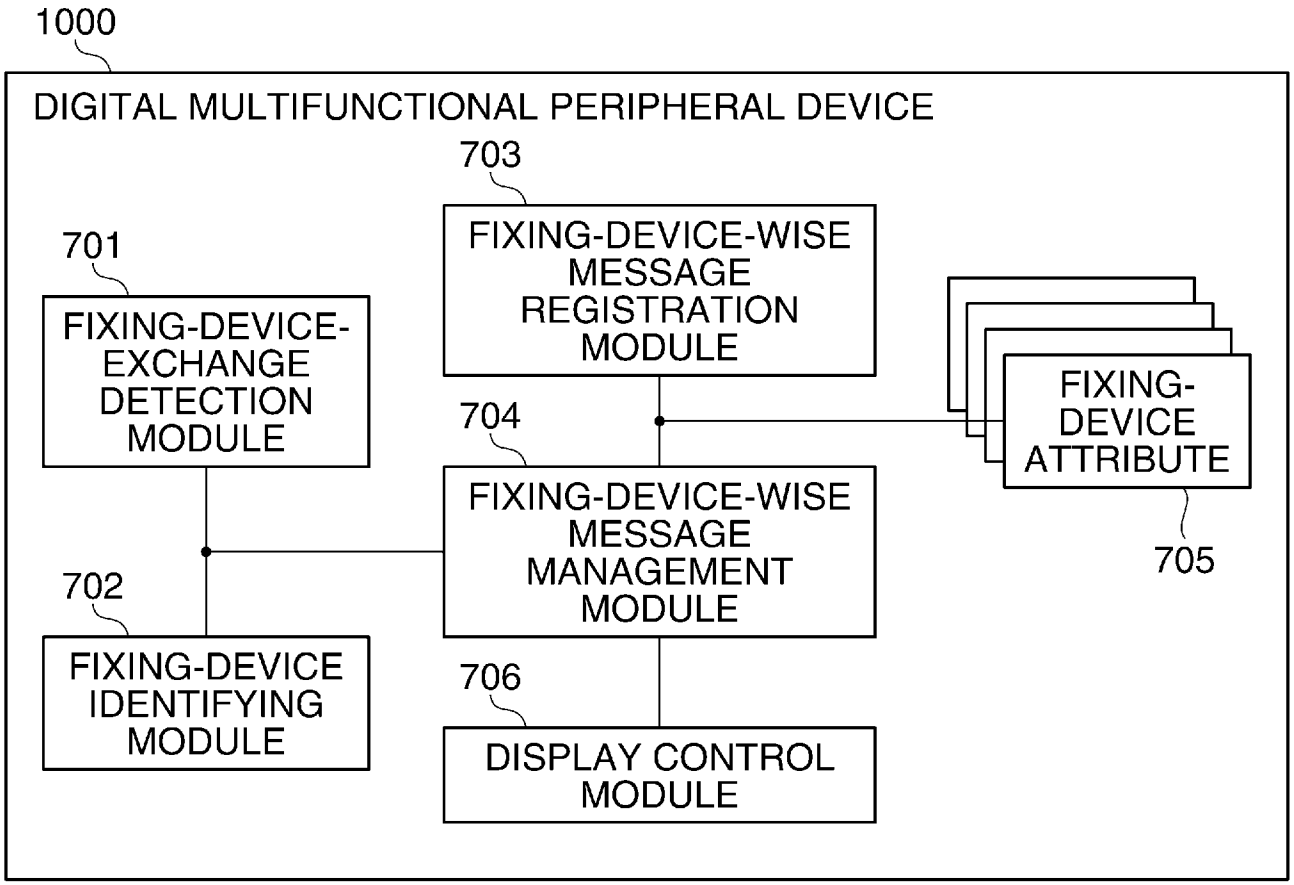
FIG. 8 is a block diagram schematically showing a configuration of function modules of the digital multifunctional peripheral device shown in FIG. 1.

FIG. 8 is a block diagram schematically showing a configuration of function modules of the digital multifunctional peripheral device 1000 shown in FIG. 1.

Each of the functional modules shown in FIG. 8 is a program module achieved when the CPU 112 executes a program stored in the program area in the ROM 114 using the RAM 113 and the external memory 31.

A fixing-device-exchange detection module 701 determines whether the fixing devices have been exchanged according to a fixing-device attachment/detachment detection signal received from the fixing-device attachment/detachment sensor 311. A fixing-device identifying module 702 identifies a fixing device according to the ID read from the fixing-device identifying device 312. It should be noted that there is a fixing device that is not provided with a fixing-device identifying device 312. In this case, a fixing-device-wise message management module 704 displays a fixing-device selection screen on the operation unit 120 according to a fixing-device attribute 705 using a display control module 706. When the operator selects a fixing device on the fixing-device selection screen, the fixing-device-wise message management module 704 recognizes that the selected fixing device shall be attached to the multifunctional peripheral device.

The operator can input a message (character string) corresponding to the fixing device through the displayed screen shown in FIG. 6B. A fixing-device-wise message registration module 703 stores the input message in association with the ID of the fixing device into the RAM 113 or the external memory 31 as the fixing-device attribute 705.

Moreover, the fixing-device-wise message management module 704 obtains the message corresponding to the ID detected by the fixing-device identifying module 702 from the fixing-device attribute 705. Then, the fixing-device-wise message management module 704 displays the message concerned on the operation unit 120 by the display control module 706.

Figure 9:
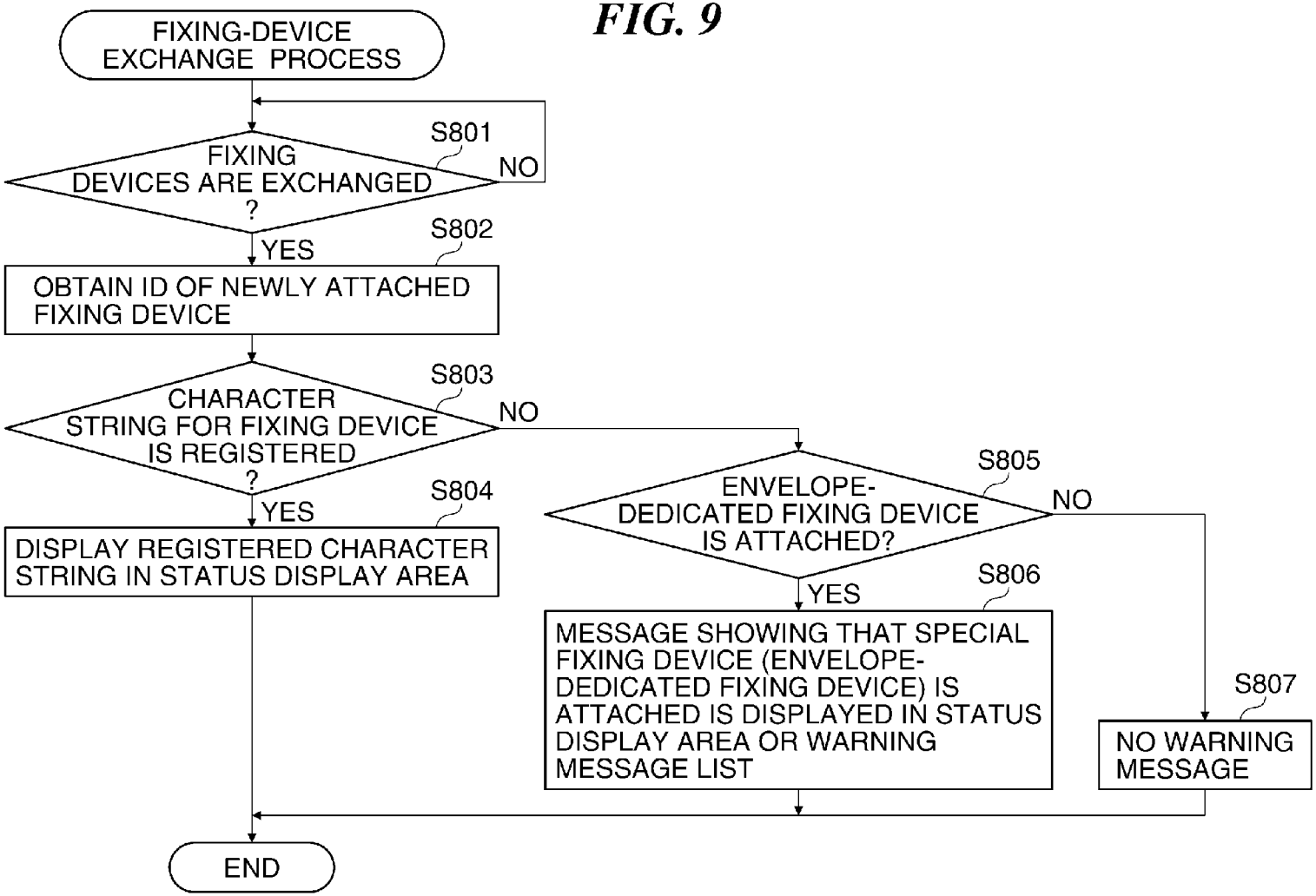
FIG. 9 is a flowchart showing procedures of a fixing-device exchange process executed in the multifunctional peripheral device shown in FIG. 1.

FIG. 9 is a flowchart showing procedures of a fixing-device exchange process executed in the multifunctional peripheral device shown in FIG. 1. It should be noted that the process concerning the illustrated flowchart is executed under the control by the main controller 30, and the process for displaying a message on the operation unit 120 when the fixing devices are exchanged will be described hereinafter.

The fixing-device-exchange detection module 701 determines whether the fixing devices are exchanged by the operator (step S801). Here, the fixing-device-exchange detection module 701 detects that the fixing device has been detached when the fixing-device attachment/detachment sensor 311 is turned OFF. Then, when the fixing-device attachment/detachment sensor 311 is turned ON, the fixing-device-exchange detection module 701 determines that the fixing device has been attached (i.e., determines that the fixing devices have been exchanged). When the fixing devices are not exchanged (NO in step S801), the fixing-device-exchange detection module 701 waits.

On the other hand, when the fixing devices are exchanged (YES in the step S801), the fixing-device identifying module 702 obtains the ID of the fixing device that was newly attached by exchange (step S802). Here, the fixing-device identifying module 702 reads the ID written in the fixing-device identifying device 312.

Subsequently, the fixing-device-wise message management module 704 reads the attribute data corresponding to the ID of the fixing device from the fixing-device attribute 705. Then, the fixing-device-wise message management module 704 determines whether character strings for the fixing device, such as a name and a warning message, are registered in the read attribute data (step S803).

When character strings, such as a name and a warning message, are registered (YES in the step S803), the fixing-device-wise message management module 704 displays the registered name and warning message on the operation unit 120 by the display control module 706 (step S804). Here, the fixing-device-wise message management module 704 displays the name and the warning message in the status display area 601 or the warning message list 602. Then, the fixing-device-wise message management module 704 finishes the fixing-device exchanging process.

When character strings, such as a name and a warning message, are not registered (NO in the step S803), the fixing-device-wise message management module 704 checks the type of the fixing device. Here, the fixing-device-wise message management module 704 determines whether the fixing device attached to the multifunctional peripheral device is an envelope-dedicated fixing device (step S805).

The type of the fixing device is determined based on the first three characters of the eight-digit serial number as the ID obtained in the step S802. When the first three characters are "ENV", the fixing-device-wise message management module 704 determines that the fixing device attached to the multifunctional peripheral device is an envelope-dedicated fixing device. On the other hand, when the first three characters are "NOR", the fixing-device-wise message management module 704 determines that the fixing device attached to the multifunctional peripheral device is a normal fixing device.

When the fixing device attached to the multifunctional peripheral device is an envelope-dedicated fixing device (YES in the step S805), the fixing-device-wise message management module 704 displays a predetermined message on the operation unit 120 by the display control module 706 (step S806). Here, the message showing that a special fixing device (envelope-dedicated fixing device) is attached is displayed, for example. This message is displayed in the status display area 601 or the warning message list 602 in the same manner as the process in the step S804. Then, the fixing-device-wise message management module 704 finishes the fixing-device exchanging process.

When the fixing device attached to the multifunctional peripheral device is not an envelope-dedicated fixing device (NO in the step S805) (i.e., when it is a normal fixing device), the fixing-device-wise message management module 704 finishes the fixing-device exchanging process without displaying a warning message (step S807) because there is no particular message that attracts operator's attention.

In this way, the first embodiment of the present invention enables to notify an operator of a message that attracts attention when the fixing device newly attached to the multifunctional peripheral device by exchanging is a special fixing device. Furthermore, an inherent display message can be registered and displayed for each fixing device.

Next, a multifunctional peripheral device according to a second embodiment of the present invention will be described. It should be noted that the configuration of the multifunctional peripheral device according to the second embodiment is the same as that of the multifunctional peripheral device shown in FIG. 1, and the control system is the same as that of the configurations shown in FIG. 2, FIG. 3, etc.

Although an arbitrary message is registered for each fixing device in the above-mentioned first embodiment, it is preferable to also register a printable medium (printable sheet) as an attribute of a fixing device. Accordingly, in the second embodiment, a method of managing a fixing device by registering a printable medium (printable sheet) in addition to an arbitrary character string as an attribute of a fixing device will be described.

As described referring to FIG. 4, a printing sheet is conveyed in the state where it is sandwiched between the fixing film 407 and the pressure roller 408 in the fixing device 20. When printing sheets of the same size in a sheet width direction that forms a right angle to the conveyance direction of printing sheets are continuously conveyed, the edges in the sheet width direction always pass the same positions of the fixing film 407 and the pressure roller 408.

Since a printing sheet has minute roughness (flash) that is formed by cutting at an edge, the flash may cause damage in the fixing film 407 and the pressure roller 408 when large number of printing sheets of the same size are continuously conveyed. This damage is called "edge damage". When a printing sheet of a larger size is printed under the condition with the edge damage, an unexpected print streak will appear.

Figure 10:
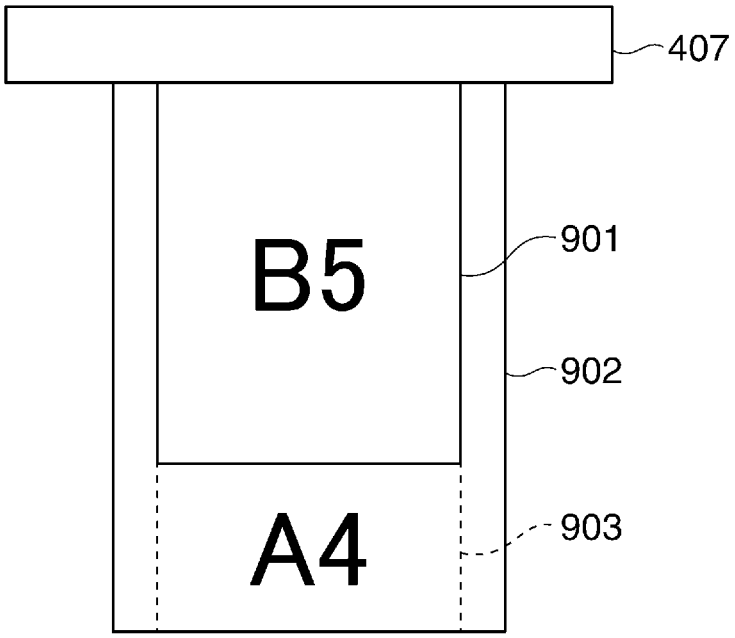
FIG. 10 is a view showing an example of the print streaks caused in the multifunctional peripheral device shown in FIG. 1.

FIG. 10 is a view showing an example of the print streaks caused in the multifunctional peripheral device shown in FIG. 1.

In FIG. 10, the fixing film 407 shown in FIG. 4 is shown from the upper side. When a large number of B5 size printing sheets 901 are continuously printed, the edge damage may occur in the fixing film 407 at positions corresponding to the edges of a B5 size printing sheet. When an A4 size printing sheet 902 is printed under this condition, the print streaks 903 appear in the A4 size printing sheet 902 because of the edge damage occurred in the fixing film 407.

Although the edge damage can also be removed by cleaning, predetermined time is needed for cleaning. Accordingly, in the field of the production print in which a large quantity of printing is performed using printing sheets of the same size, the fixing devices are exchanged whenever a size of printing sheets is changed so that the fixing device dedicated to a sheet size to be used is attached.

To perform such a production print, it is required to register and manage a printable medium for each fixing device.

Figure 11A:
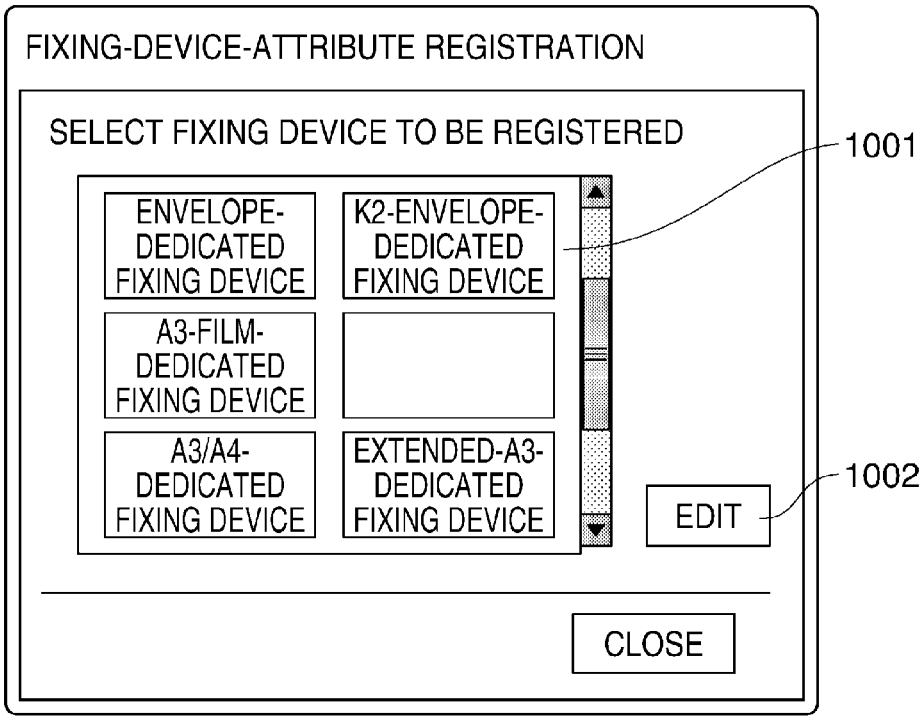
FIG. 11A is a view showing an example of a fixing-device-attribute registration screen displayed on an operation unit when an operator selects a fixing device to which a printable medium (printing sheet) is registered in a multifunctional peripheral device according to a second embodiment of the present invention.
Figure 11B:
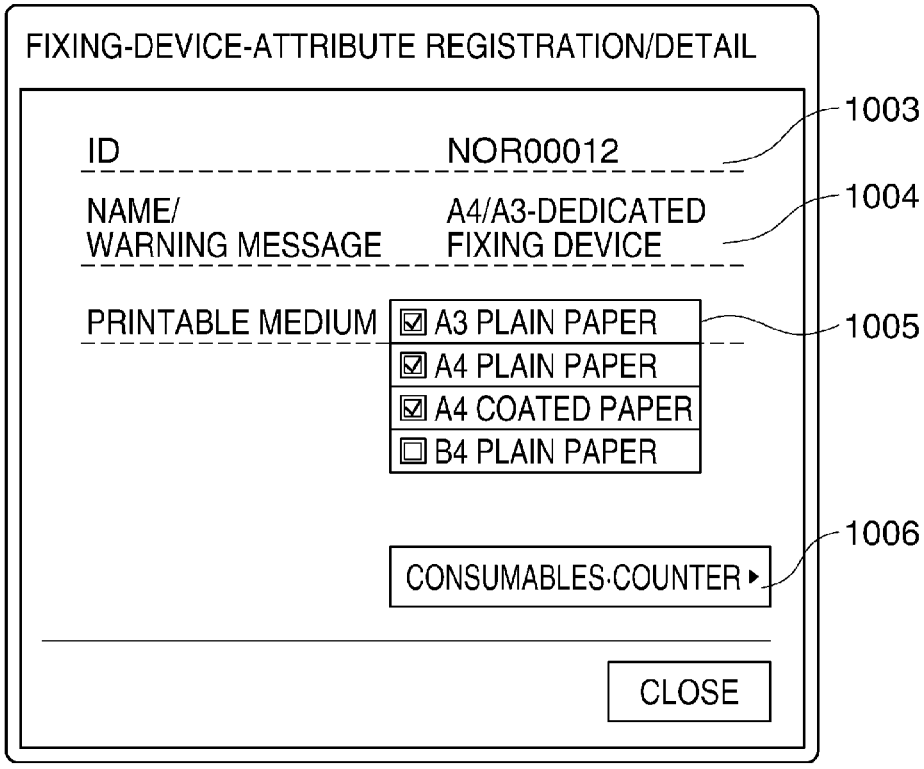
FIG. 11B is a view showing an example of a fixing-device-attribute registration/detail screen displayed on the operation unit when the operator registers the printable medium to the individual fixing device selected on the screen shown in FIG. 11A.

FIG. 11A is a view showing an example of a fixing-device-attribute registration screen displayed on an operation unit when an operator selects a fixing device to which a printable medium is registered in the multifunctional peripheral device according to the second embodiment of the present invention. FIG. 11B is a view showing an example of a fixing-device-attribute registration/detail screen displayed on the operation unit when the operator registers the printable medium to the individual fixing device selected on the screen shown in FIG. 11A.

When a predetermined operation is performed on the setting/registration screen shown in FIG. 6A, the CPU 112 displays the fixing-device-attribute registration screen shown in FIG. 11A on the operation unit 120. A list 1001 of the fixing devices that the multifunctional peripheral device 1000 manages is displayed in the fixing-device-attribute registration screen.

When an operator selects one of the fixing devices and pushes an edit button 1002 on the fixing-device-attribute registration screen, the CPU 112 displays the fixing-device-attribute registration/detail screen shown in FIG. 11B on the operation unit 120. In the fixing-device-attribute registration/detail screen, an ID 1003, a name/warning message 1004, and a printable medium list 1005 are displayed.

The name/warning message 1004 is the same contents as the fixing device name described referring to FIG. 6B, and arbitrary character strings can be registered. The printable medium list 1005 shows printable media designated by the fixing device.

This medium list is a list of the media that the multifunctional peripheral device 1000 supports, and includes media that a printer manufacturer prepares beforehand and media that an operator registers. When a check box arranged at a left side of each medium in the printable medium list is selected, the CPU 112 registers the medium as a medium printable by the fixing device concerned.

Figure 12:
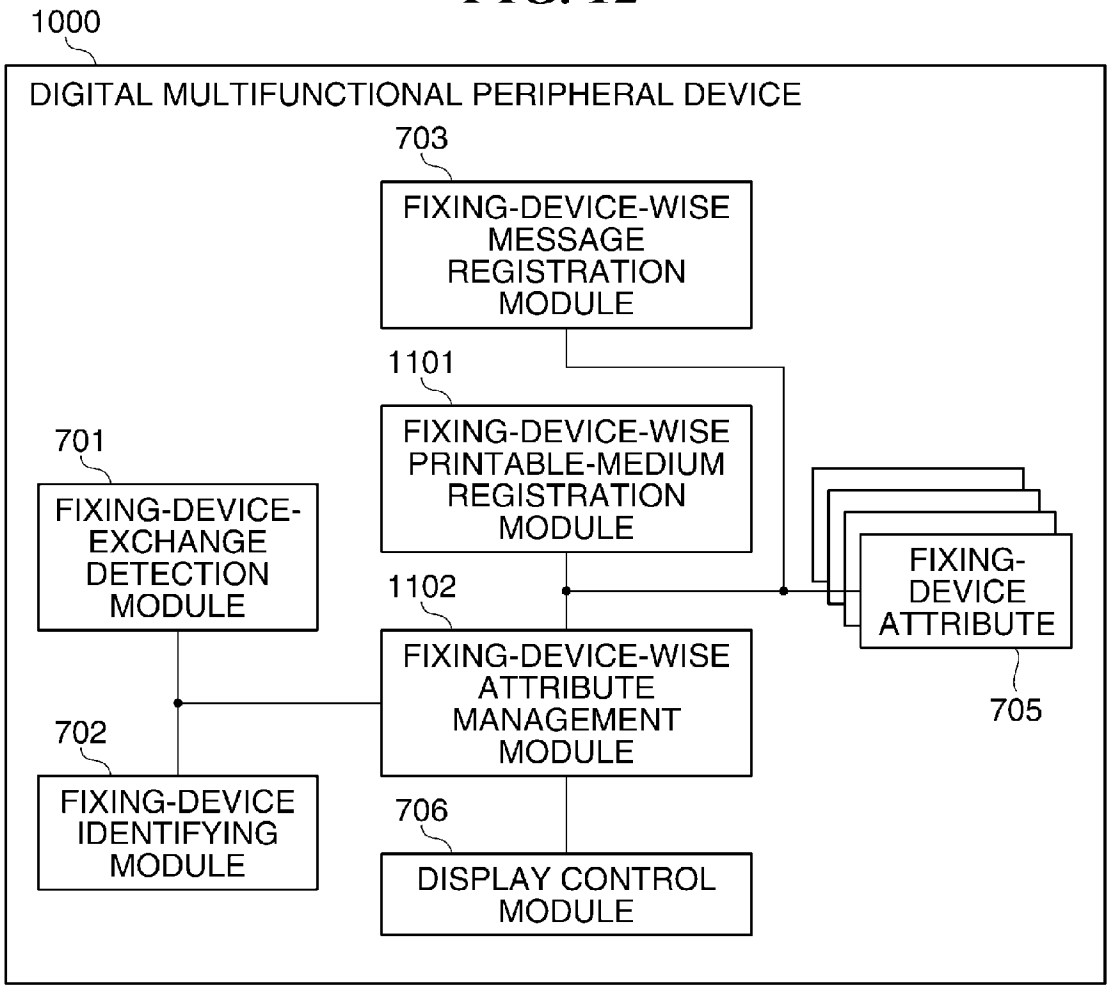
FIG. 12 is a block diagram schematically showing a configuration of function modules in the multifunctional peripheral device according to the second embodiment of the present invention.

FIG. 12 is a block diagram schematically showing a configuration of function modules in the multifunctional peripheral device according to the second embodiment of the present invention.

It should be noted that the function modules in FIG. 12 that are identical to that in FIG. 8 are labeled by the same reference numerals, and their descriptions are omitted. Moreover, each of the functional modules shown in FIG. 12 is a program module achieved when the CPU 112 executes a program stored in the program area in the ROM 114 using the RAM 113 and the external memory 31.

A fixing-device-wise printable-medium registration module 1101 registers a printable medium (printable sheet)

selected on the fixing-device-attribute registration/detail screen shown in FIG. 11B as printable-medium information in the fixing device concerned. This printable-medium information is stored into the RAM 113 or the external memory 31 as the fixing-device attribute 705, for example.

Moreover, a fixing-device-wise attribute management module 1102 obtains the attribute data of the fixing device corresponding to the ID detected by the fixing-device identifying module 702 from the fixing-device attribute 705. The attribute data includes the ID 1003, the name/warning message 1004, and the printable medium list 1005 that have been described referring to FIG. 11B. Then, the fixing-device-wise message management module 1102 displays the attribute data as a message on the operation unit 120 by the display control module 706.

Figure 13:
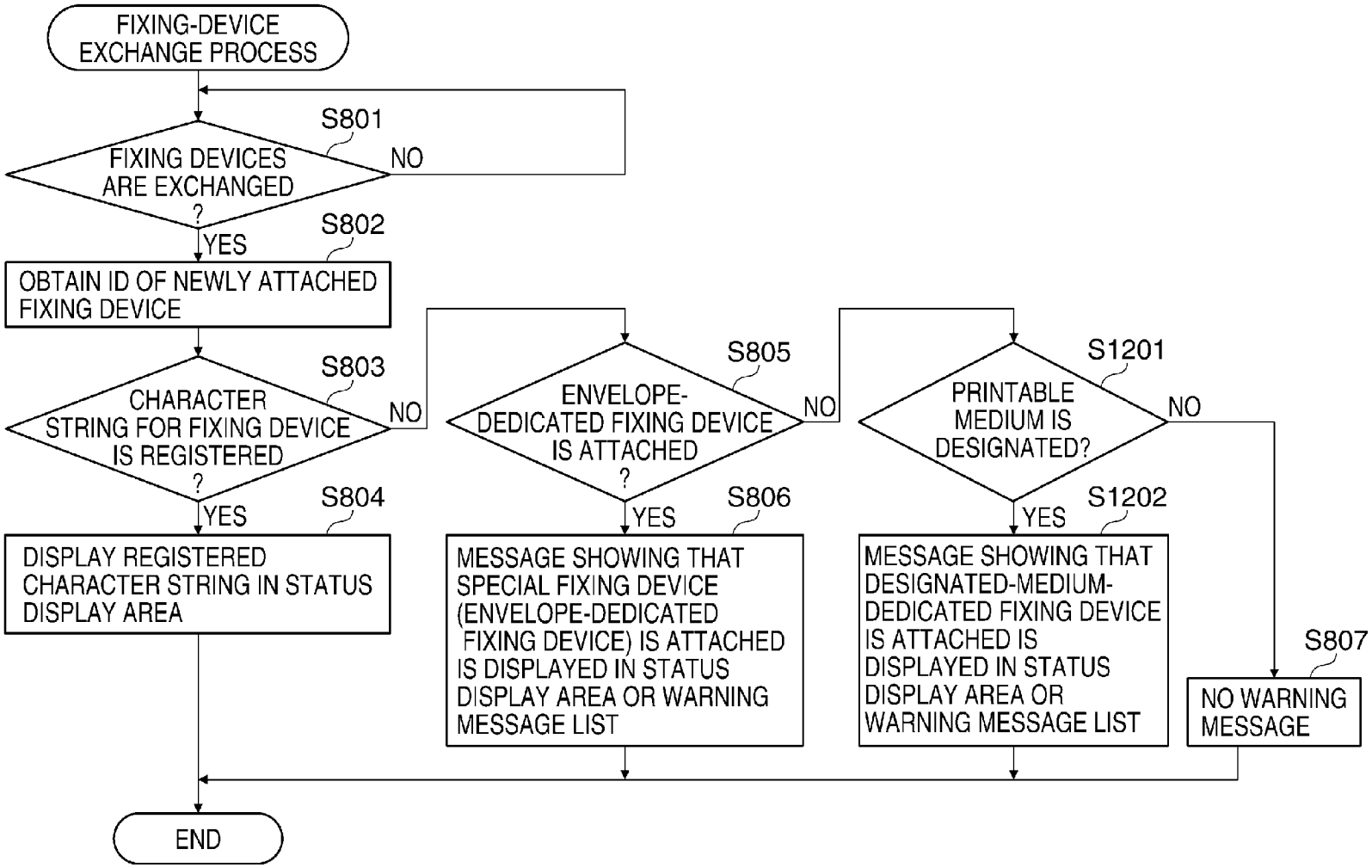
FIG. 13 is a flowchart showing procedures of a fixing-device exchanging process executed in the multifunctional peripheral device according to the second embodiment of the present invention.

FIG. 13 is a flowchart showing procedures of a fixing-device exchanging process executed in the multifunctional peripheral device according to the second embodiment of the present invention. It should be noted that steps in FIG. 13 that are the same as the steps in the flowchart in FIG. 9 are labeled by the same reference numerals, and their descriptions are omitted.

In step S805 in FIG. 13, when the envelope-dedicated fixing device is not attached to the multifunctional peripheral device, the fixing-device-wise attribute management module 1102 reads the fixing-device attribute 705 and determines whether a printable medium is designated (step S1201). When the printable medium is designated (YES in the step S1201), the fixing-device-wise attribute management module 1102 displays that the attached fixing device is dedicated to the designated medium on the operation unit 120 by the display control module 706 (step S1202).

In this case, the message showing that the fixing device is dedicated to the designated medium is displayed in the status display area 601 or the warning message list 602 shown in FIG. 7B. For example, when only A4 and A3 sizes are designated as printable media, the fixing-device-wise attribute management module 1102 displays a message "A4/A3 Dedicated" by the display control module 706. Then, the fixing-device-wise attribute management module 1102 finishes the fixing-device exchanging process.

On the other hand, when a printable medium is not designated (NO in the step S1201), the fixing-device-wise attribute management module 1102 finishes the fixing-device exchanging process without displaying a warning message (step S807).

In this way, in the second embodiment of the present invention, when the printable medium is designated in the fixing device, the message to that effect is displayed on the operation unit 120, which attracts operator's attention.

Next, a multifunctional peripheral device according to a third embodiment of the present invention will be described. It should be noted that the configuration of the multifunctional peripheral device according to the third embodiment is the same as that of the multifunctional peripheral device shown in FIG. 1, and the control system is the same as that of the configurations shown in FIG. 2, FIG. 3, etc.

In the above-mentioned second embodiment, when a printable medium is designated in a fixing device, a message to that effect is displayed on the operation unit 120. In the third embodiment, a cassette management control process that makes only a sheet cassette that stores the printing sheets corresponding to registered printable-medium information be available is performed.

Figure 14:
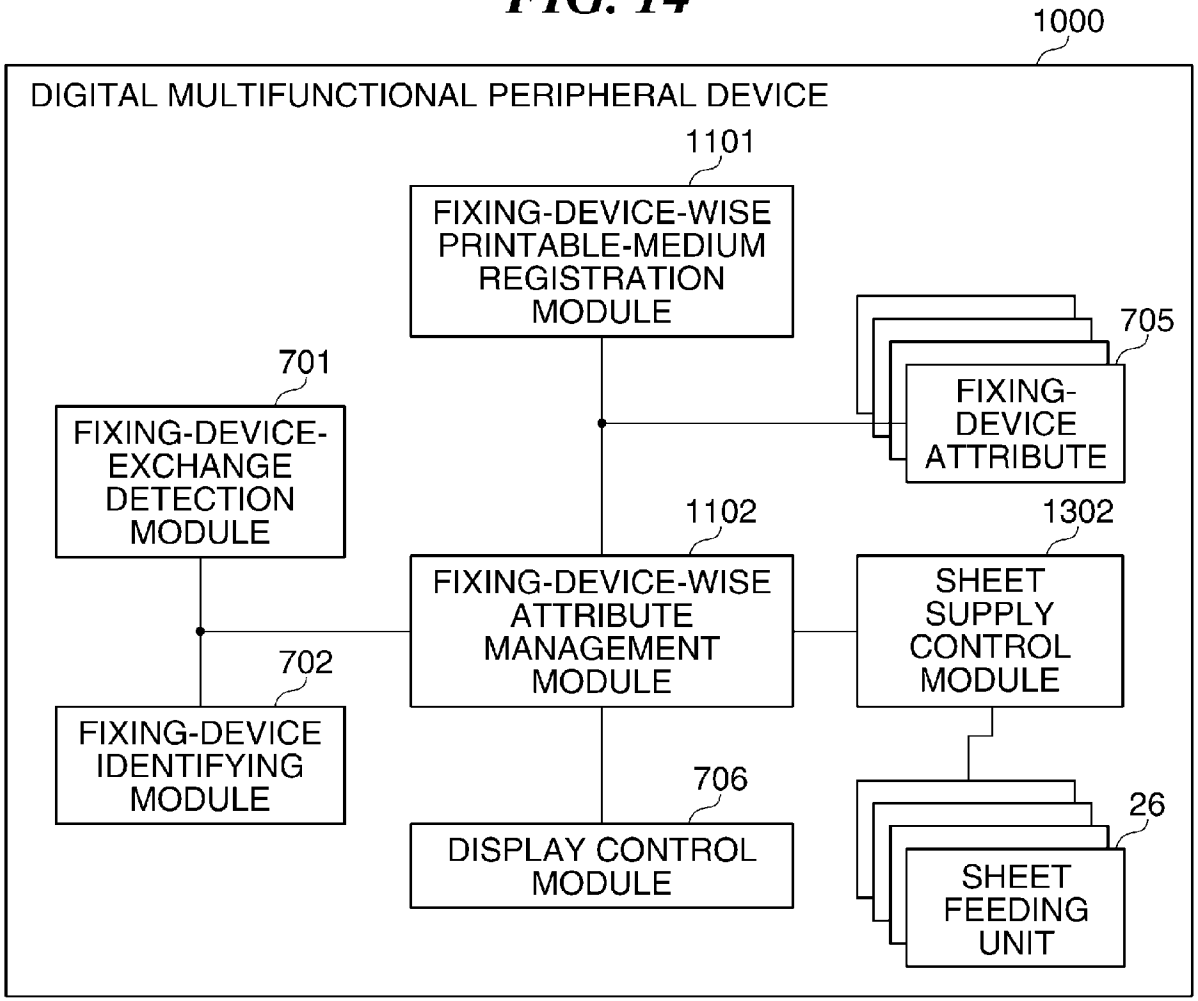
FIG. 14 is a block diagram schematically showing a configuration of function modules in the multifunctional peripheral device according to a third embodiment of the present invention.

FIG. 14 is a block diagram schematically showing a configuration of function modules in the multifunctional peripheral device according to the third embodiment of the present invention.

It should be noted that the function modules in FIG. 14 that are identical to that in FIG. 8 are labeled by the same reference numerals, and their descriptions are omitted. Moreover, each of the functional modules shown in FIG. 14 is a program module achieved when the CPU 112 executes a program stored in the program area in the ROM 114 using the RAM 113 and the external memory 31.

In FIG. 14, a sheet supply control module 1302 detects a size and remaining amount of media stored in each cassette from the sheet size sensor 309 and residual sheet sensor 310 of the sheet feeding unit 26 shown in FIG. 3, and controls operations of the sheet feeding unit 26 according to the information from the fixing-device-wise attribute management module 1102 as mentioned below.

Figure 15:
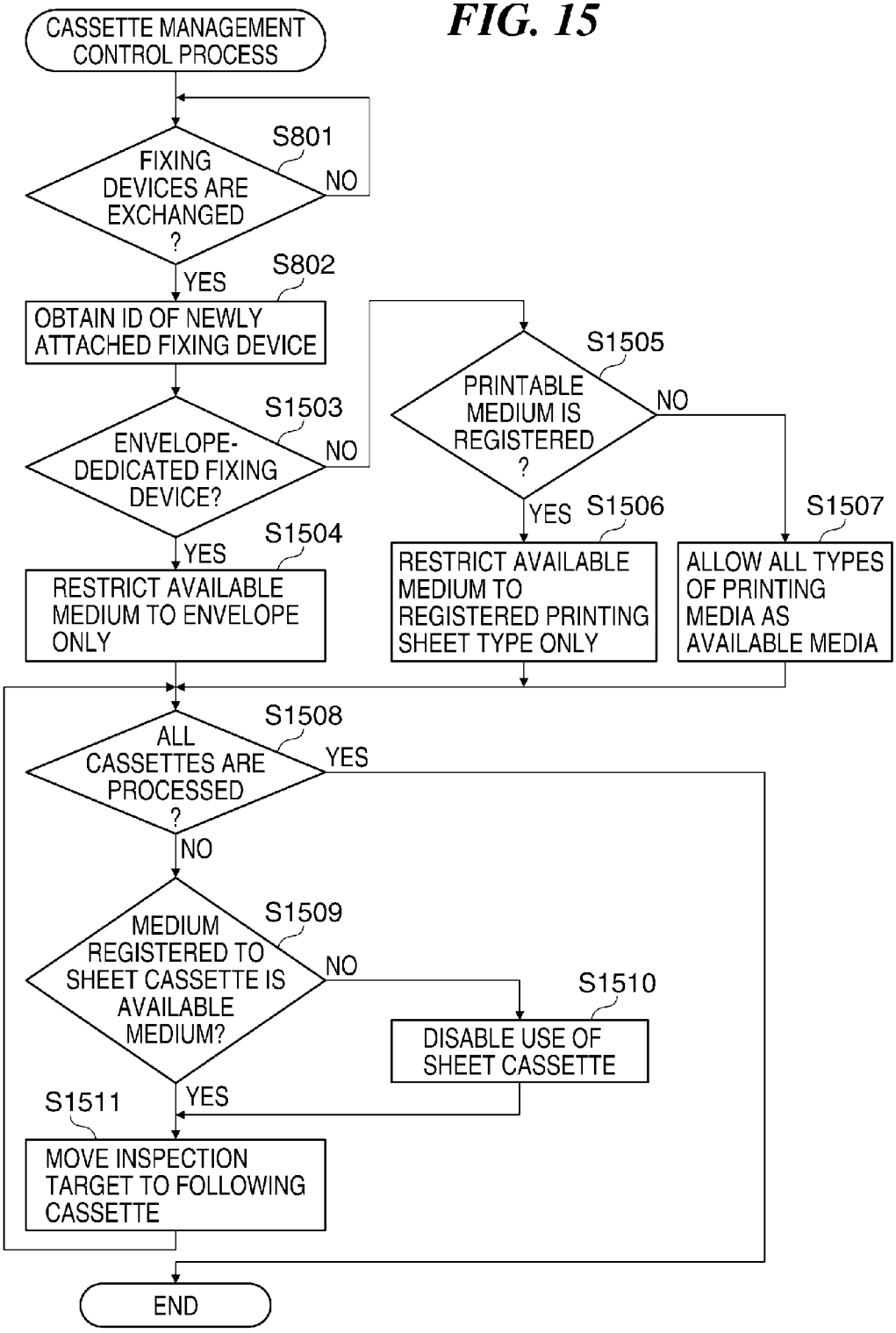
FIG. 15 is a flowchart showing procedures of a cassette management control process executed in the multifunctional peripheral device according to the third embodiment of the present invention.

FIG. 15 is a flowchart showing procedures of a cassette management control process executed in the multifunctional peripheral device according to the third embodiment of the present invention. It should be noted that steps in FIG. 15 that are the same as the steps in the flowchart in FIG. 9 are labeled by the same reference numerals, and their descriptions are omitted.

In the step S802 in FIG. 15, after identifying the fixing device, the fixing-device identifying module 702 determines whether the fixing device concerned is an envelope-dedicated fixing device (step S1503). Then, when the fixing device attached to the multifunctional peripheral device is an envelope-dedicated fixing device (YES in the step S1503), the sheet supply control module 1302 restricts an available medium to an envelope only (step S1504).

When the fixing device attached to the multifunctional peripheral device is not an envelope-dedicated fixing device (NO in the step S1503) (i.e., when it is a normal fixing device), the fixing-device-wise attribute management module 1102 checks whether a printable medium is registered to the fixing device concerned (step S1505). When the printable medium is registered (YES in the step S1505), the sheet supply control module 1302 restricts an available medium to the registered printing sheet type only (step S1506).

On the other hand, when a printable medium is not registered (NO in the step S1505), the sheet supply control module 1302 allows all types of printing media (i.e., printing sheets) as available media (step S1507).

After the process in the step S1504, S1506, or S1507, the sheet supply control module 1302 determines whether an available/unavailable determination process has been performed for all the sheet cassettes (step S1508). When the available/unavailable determination process is performed for not all the sheet cassettes (NO in the step S1508), the sheet supply control module 1302 obtains the medium information in a sheet cassette from the sheet supply unit 1301, and determines whether the printing sheet shown by the medium information concerned coincides with the available media (step S1509).

When the printing sheet shown by the medium information does not coincide with the available medium (NO in the step S1509), the sheet supply control module 1302 disables the use of the sheet cassette concerned in the sheet feeding unit 26 (step S1510). Then, the sheet supply control module 1302 moves an inspection target to the following cassette (step S1511), and returns the process to the step S1508.

When the printing sheet shown by the medium information coincides with the available medium (YES in the step S1509), the sheet supply control module 1302 proceeds with the process to the step S1511 without disabling the use of the sheet cassette concerned. When the available/unavailable determination process has been performed for all the sheet cassettes (YES in the step S1508), the sheet supply control module 1302 finishes the cassette management control process.

Figure 16A:
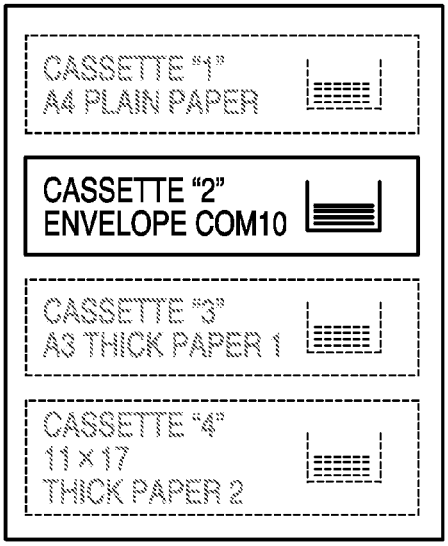
FIG. 16A and FIG. 16B are views showing examples of available cassette screens displayed on the operation unit after executing the cassette management control process shown in FIG. 15.
Figure 16B:
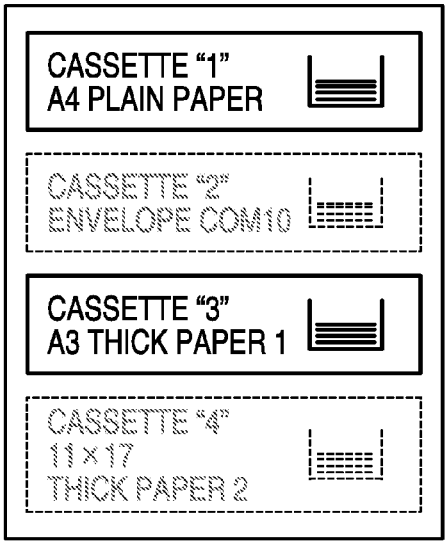

FIG. 16A and FIG. 16B are views showing examples of available cassette screens displayed on the operation unit after executing the cassette management control process shown in FIG. 15.

When the envelope-dedicated fixing device is attached to the multifunctional peripheral device 1000, an icon of the cassette "2" that stores envelopes is emphasized and displayed on the operation unit 120 as shown in FIG. 16A. Moreover, when an A4/A3-dedicated fixing device, which is a normal fixing device, is attached to the multifunctional peripheral device 1000, an icon of the cassette "1" that stores A4 plain paper and an icon of the cassette "3" that stores A3 thick paper are emphasized and displayed on the operation unit 120 as shown in FIG. 16B.

After the cassette management control process described referring to FIG. 15 is completed, only a sheet cassette that stores the printable medium corresponding to the fixing device attached to the multifunctional peripheral device 1000 becomes available. As a result of this, the third embodiment of the present invention is able to prevent a situation where an operator designates a wrong sheet cassette and a printed matter that is not intended is output.

Next, a multifunctional peripheral device according to a fourth embodiment of the present invention will be described. It should be noted that the configuration of the multifunctional peripheral device according to the fourth embodiment is the same as that of the multifunctional peripheral device shown in FIG. 1, and the control system is the same as that of the configurations shown in FIG. 2, FIG. 3, etc.

In the above-mentioned first embodiment, the fixing-device-exchange detection module 701 determines whether the fixing devices have been exchanged according to the fixing-device attachment/detachment detection signal received from the fixing-device attachment/detachment sensor 311. Furthermore, even when there is no mechanism that detects exchange of fixing devices, it is preferable to manage a plurality of fixing devices appropriately according to usages. Accordingly, the fourth embodiment describes a method for managing fixing devices considering a case where there is no mechanism that detects exchange of fixing devices.

In the multifunctional peripheral device according to the fourth embodiment, an individual name is registered with respect to each of a plurality of fixing devices. When a change of the name of the fixing device attached to the multifunctional peripheral device is detected, a changed name is displayed on a screen of the operation unit 120.

Figure 17A:
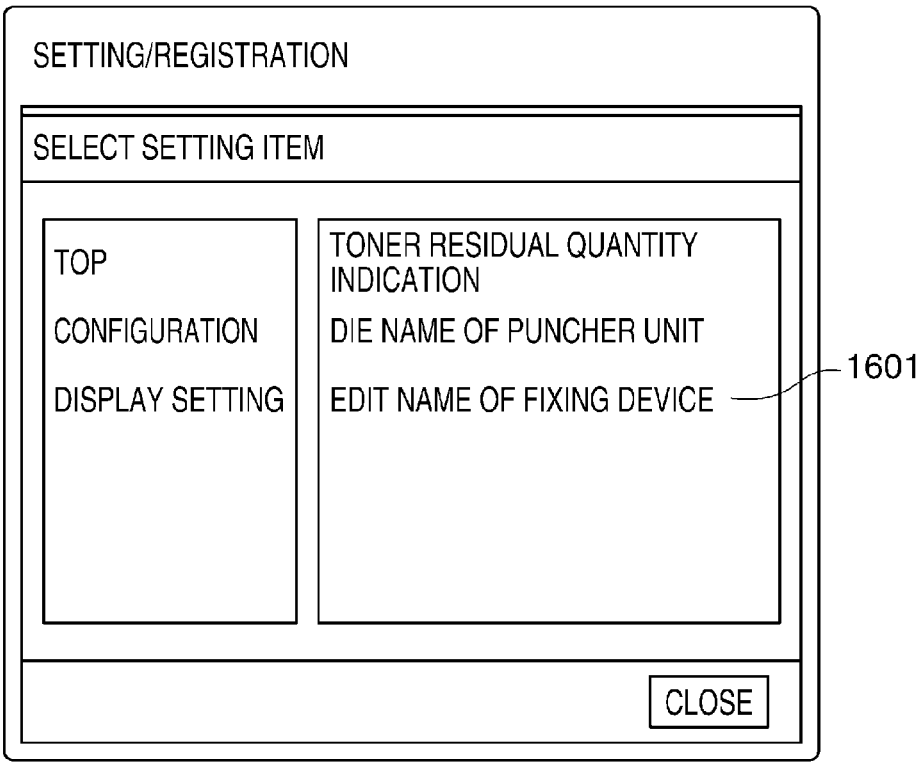
FIG. 17A is a view showing a setting/registration screen displayed on an operation unit when a setting of an attached fixing device is changed in a multifunctional peripheral device according to a fourth embodiment of the present invention.
Figure 17B:
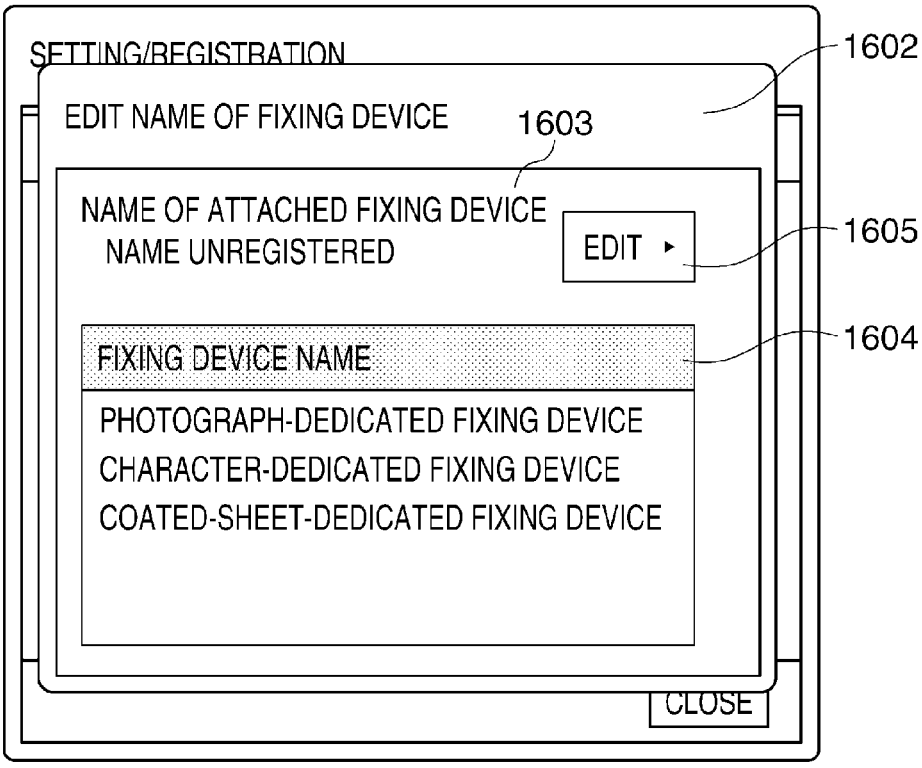
FIG. 17B is a view showing an example of a fixing-device-name edit dialog displayed over the setting/registration screen in FIG. 17A when a name of a fixing device is changed.
Figure 17C:
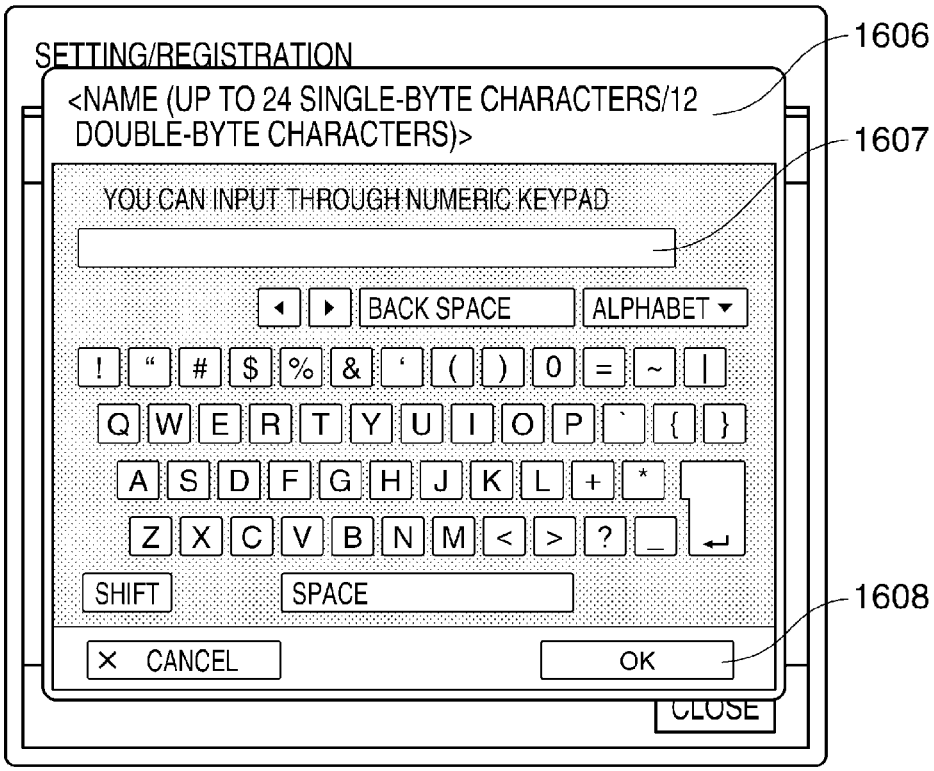
FIG. 17C is a view showing a fixing-device-name input dialog displayed when an edit button in FIG. 17B is pushed.
Figure 17D:
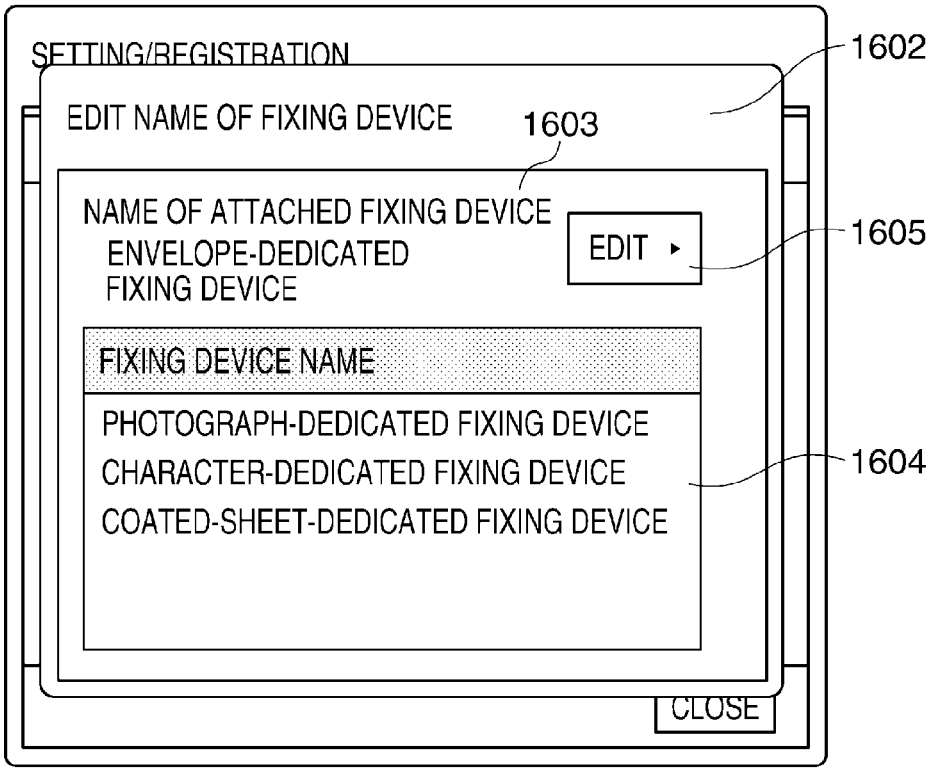
FIG. 17D is a view showing another example of the fixing-device-name edit dialog in which the name input in the dialog in FIG. 17C is reflected.

FIG. 17A is a view showing a setting/registration screen displayed on the operation unit 120 when a setting of an attached fixing device is changed in the multifunctional peripheral device according to the fourth embodiment of the present invention. FIG. 17B is a view showing an example of a fixing-device-name edit dialog displayed over the setting/registration screen in FIG. 17A when a name of a fixing device is changed. Moreover, FIG. 17C is a view showing a fixing-device-name input dialog displayed when an edit button in FIG. 17B is pushed. FIG. 17D is a view showing another example of the fixing-device-name edit dialog in which the name input in the dialog in FIG. 17C is reflected.

An operator operates the operation unit 120 to display the setting/registration screen (FIG. 17A) on the operation unit 120. In the setting/registration screen, when a selection of a fixing-device-name edit menu 1601 is detected, the CPU 112 displays the fixing-device-name edit dialog 1602 shown in FIG. 17B on the operation unit 120. FIG. 17B shows the state where the multifunctional peripheral device is equipped with the fixing device of which a name has not yet registered.

In the fixing-device-name edit dialog 1602, the character string "Name Unregistered", which is displayed when a name of the fixing device is not registered, is displayed in a name label area 1603, and a fixing-device-name list 1604 is displayed. The names of the fixing devices stored by the multifunctional peripheral device are displayed in the registered fixing device list 1604.

When depression of a fixing-device-name edit button 1605 in the fixing-device-name edit dialog 1602 is detected, the CPU 112 displays the fixing-device-name input dialog 1606 shown in FIG. 17C on the operation unit 120. FIG. 17C shows the state of waiting an input about a name of the fixing device of which a name has not yet registered.

In the fixing-device-name input dialog 1606, a software keyboard and a character string display area 1607 that displays a character string input by the operator are displayed.

When detecting depression of an OK button 1608 in the fixing-device-name input dialog 1606, the CPU 112 registers the character string displayed on the character string display area 1607 as the name of the fixing device attached to the multifunctional peripheral device, and displays the fixing-device-name edit dialog 1602 shown in FIG. 17D on the operation unit 120. FIG. 17D shows the status where the character string "Envelope-dedicated fixing device" has been registered as the name of the fixing device attached to the multifunctional peripheral device.

Figure 18A:
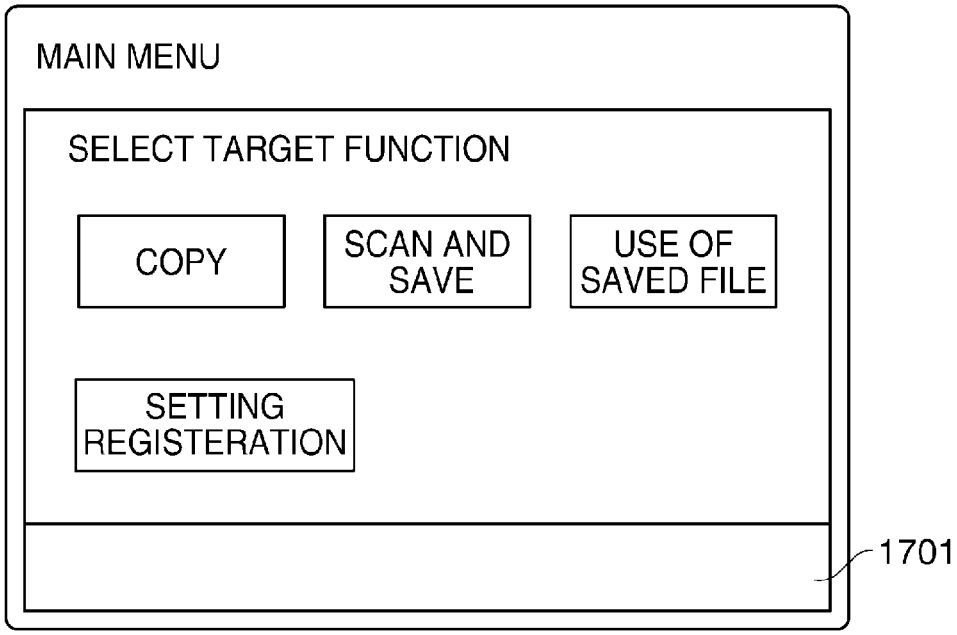
FIG. 18A is a view showing an example of a main menu screen displayed on the operation unit of the multifunctional peripheral device according to the fourth embodiment of the present invention.
Figure 18B:
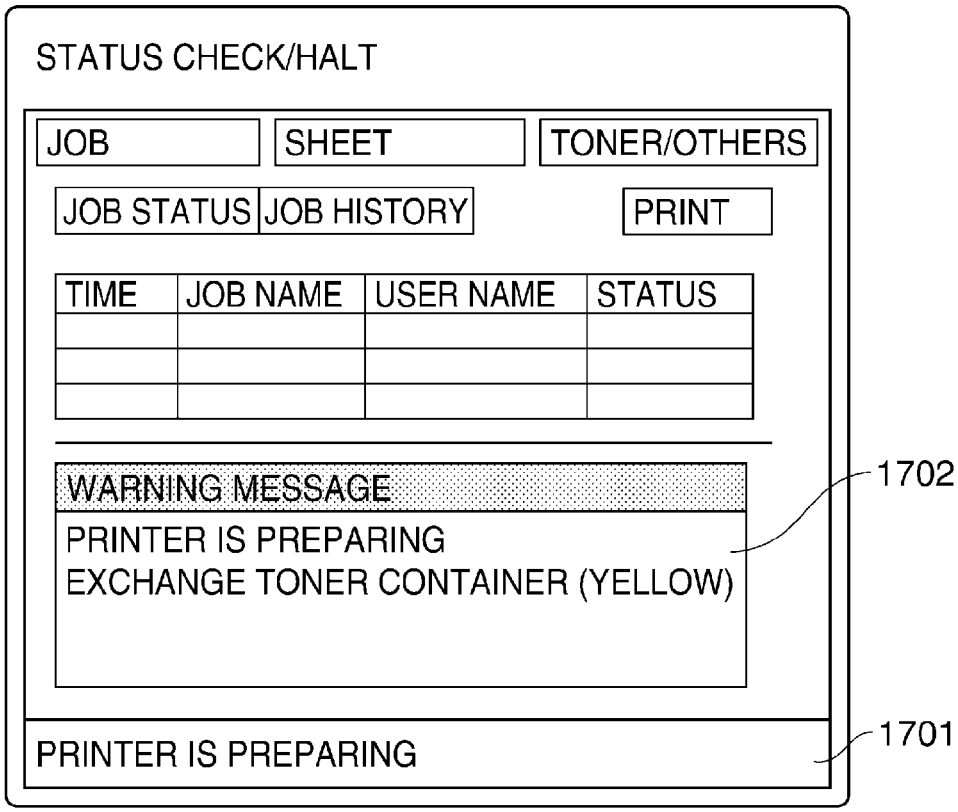
FIG. 18B is a view showing an example of the status check/halt screen displayed on the operation unit in the multifunctional peripheral device according to the fourth embodiment of the present invention.
Figure 18C:
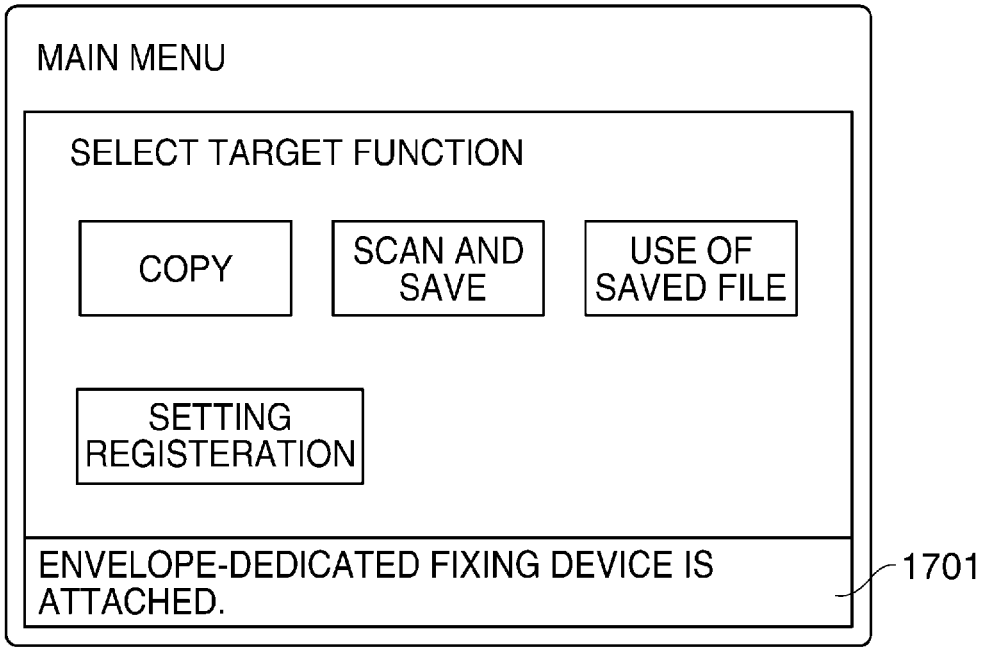
FIG. 18C is a view showing another example of the main menu screen displayed on the operation unit in the multifunctional peripheral device according to the fourth embodiment of the present invention.
Figure 18D:
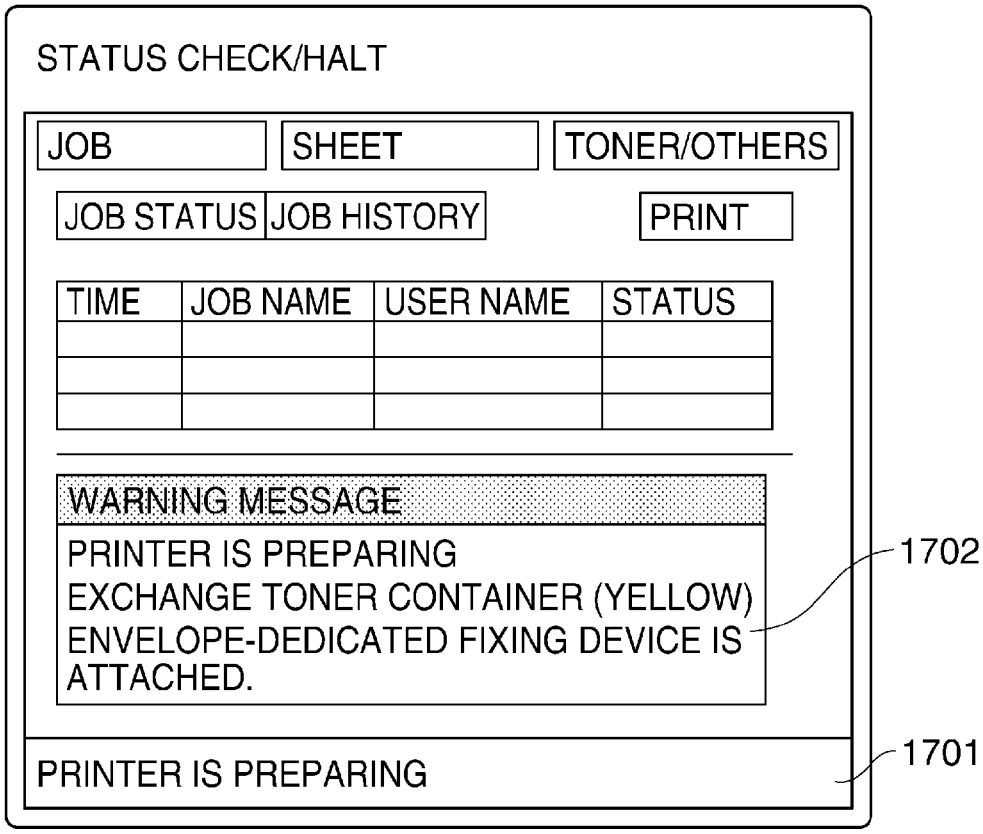
FIG. 18D is a view showing another example of the status check/halt screen displayed on the operation unit in the multifunctional peripheral device according to the fourth embodiment of the present invention.

FIG. 18A is a view showing an example of a main menu screen displayed on the operation unit 120 of the multifunctional peripheral device according to the fourth embodiment of the present invention. FIG. 18B is a view showing an example of a status check/halt screen displayed on the operation unit 120 of the multifunctional peripheral device according to the fourth embodiment of the present invention. Moreover, FIG. 18C is a view showing another example of the main menu screen, and FIG. 18D is a view showing another example of the status check/halt screen.

When the power of the multifunctional peripheral device is turned ON and the multifunctional peripheral device is started, the CPU 112 displays the main menu screen, which is an initial screen, shown in FIG. 18A on the operation unit 120.

Similarly, when the multifunctional peripheral device returns from a power-saving mode, the CPU 112 displays the main menu screen shown in FIG. 18A on the operation unit 120. It should be noted that the lowermost rows of the main menu screen and the status check/halt screen are reserved as status display areas 1701.

The CPU 112 will display a message in the status display area 1701, if a certain phenomenon which an operator should know occurs. For example, the CPU 112 displays that the printer is preparing as shown in FIG. 18B in the status display area 1701. Moreover, the CPU 112 displays the name of the attached fixing device in the status display area 1701 to notify the operator. FIG. 18A shows the state where the multifunctional peripheral device is equipped with the fixing device of which a name has not yet registered. On the other hand, FIG. 18C shows the status where the multifunctional peripheral device is equipped with the fixing device to which the character string "Envelope-dedicated fixing device" is registered.

Since the status display area 1701 is a narrow area, the name of the fixing device may not be displayed when another message with a higher priority is displayed. In such a case, the name of the fixing device can be checked by looking a warning message list 1702 in the status check/halt screen shown in FIG. 18D.

When a status check/halt dedicated button (not shown) of the operation unit 120 is depressed, the CPU 112 displays the status check/halt screen on the operation unit 120. In the example shown in FIG. 18B, the status where the printer is preparing and the status where a toner container is necessary to be exchanged are displayed, and the status where the multifunctional peripheral device is equipped with the fixing device of which the name has not yet been registered is shown.

In the example shown in FIG. 18D, the status where the printer is preparing and the status where a toner container is necessary to be exchanged are displayed, and the status where the multifunctional peripheral device is equipped with the fixing device to which the character string "Envelope-dedicated fixing device" is registered is shown.

Figure 19:
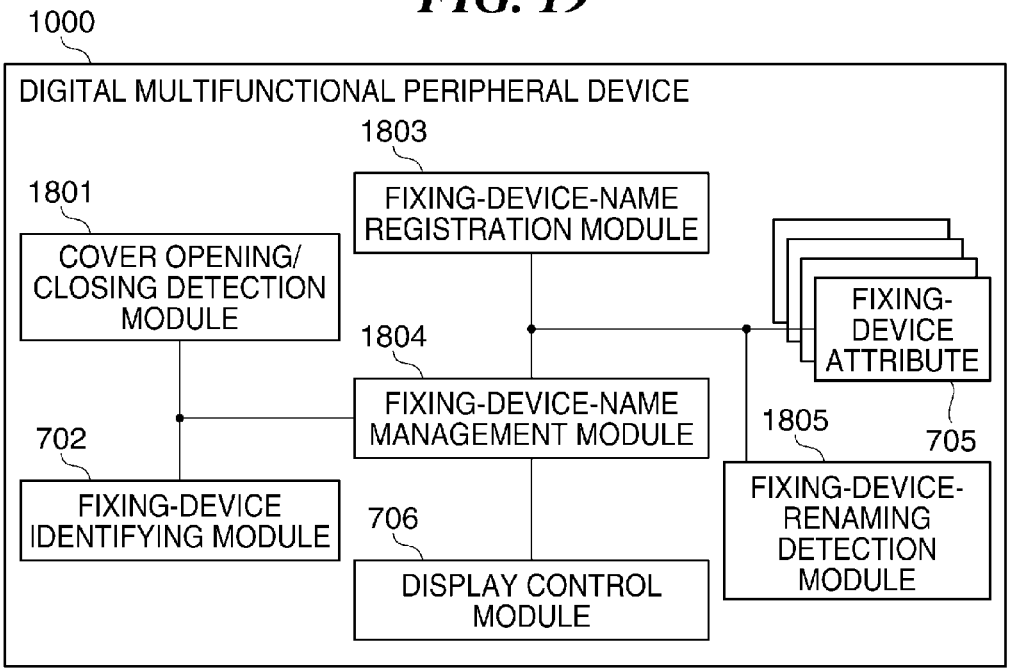
FIG. 19 is a block diagram schematically showing a configuration of function modules in the multifunctional peripheral device according to the fourth embodiment of the present invention.

FIG. 19 is a block diagram schematically showing a configuration of function modules in the multifunctional peripheral device according to the fourth embodiment of the present invention.

It should be noted that the function modules in FIG. 19 that are identical to that in FIG. 8 are labeled by the same reference numerals, and their descriptions are omitted. Moreover, each of the functional modules shown in FIG. 19 is a program module achieved when the CPU 112 executes a program stored in the program area in the ROM 114 using the RAM 113 and the external memory 31.

A cover opening/closing detection module 1801 determines whether the body front cover 315 is closed according to an opening/closing signal received from the cover opening/closing sensor 314 shown in FIG. 3.

A fixing-device-name registration module 1803 registers a character string that the operator inputs through the displayed screen shown in FIG. 17C as a name of the fixing device. This name of the fixing device is stored into the RAM 113 or the external memory 31 as the fixing-device attribute 705, for example.

Moreover, a fixing-device-name management module 1804 obtains the name of the fixing device corresponding to the identification information detected by the fixing-device identifying module 702 from the fixing-device attribute 705. Then, the fixing-device-name management module 1804 displays the name of the fixing device concerned on the operation unit 120 by the display control module 706.

A fixing-device-renaming detection module 1805 determines whether the name of the fixing device attached to the multifunctional peripheral device has been changed, when the fixing-device-name registration module 1803 stored the name of the fixing device as the fixing-device attribute 705.

Figure 20:
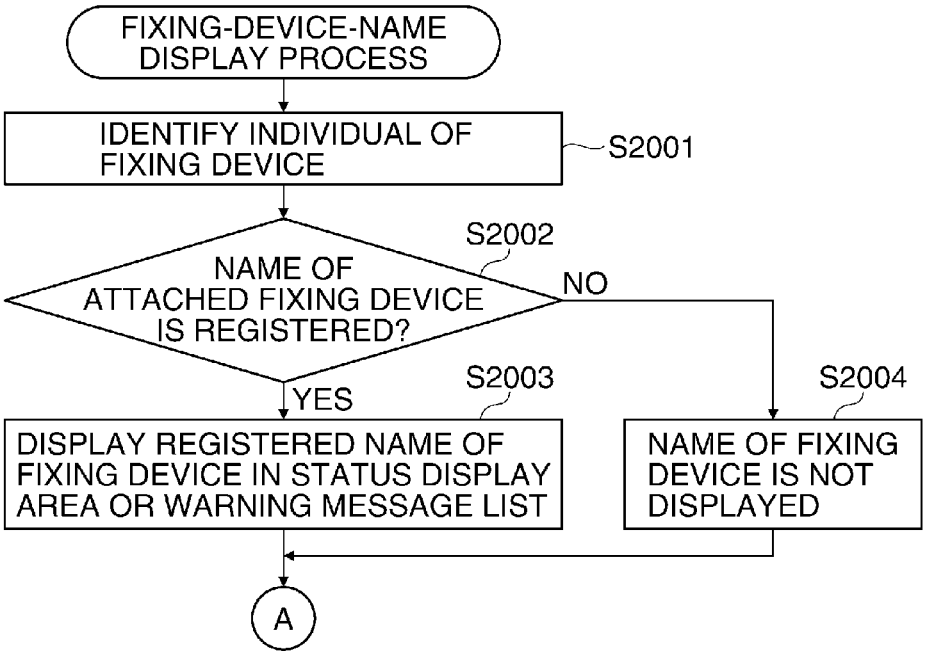
FIG. 20 is a flowchart showing procedures in the first half of a fixing-device-name display process executed in the multifunctional peripheral device according to the fourth embodiment of the present invention.
Figure 21:
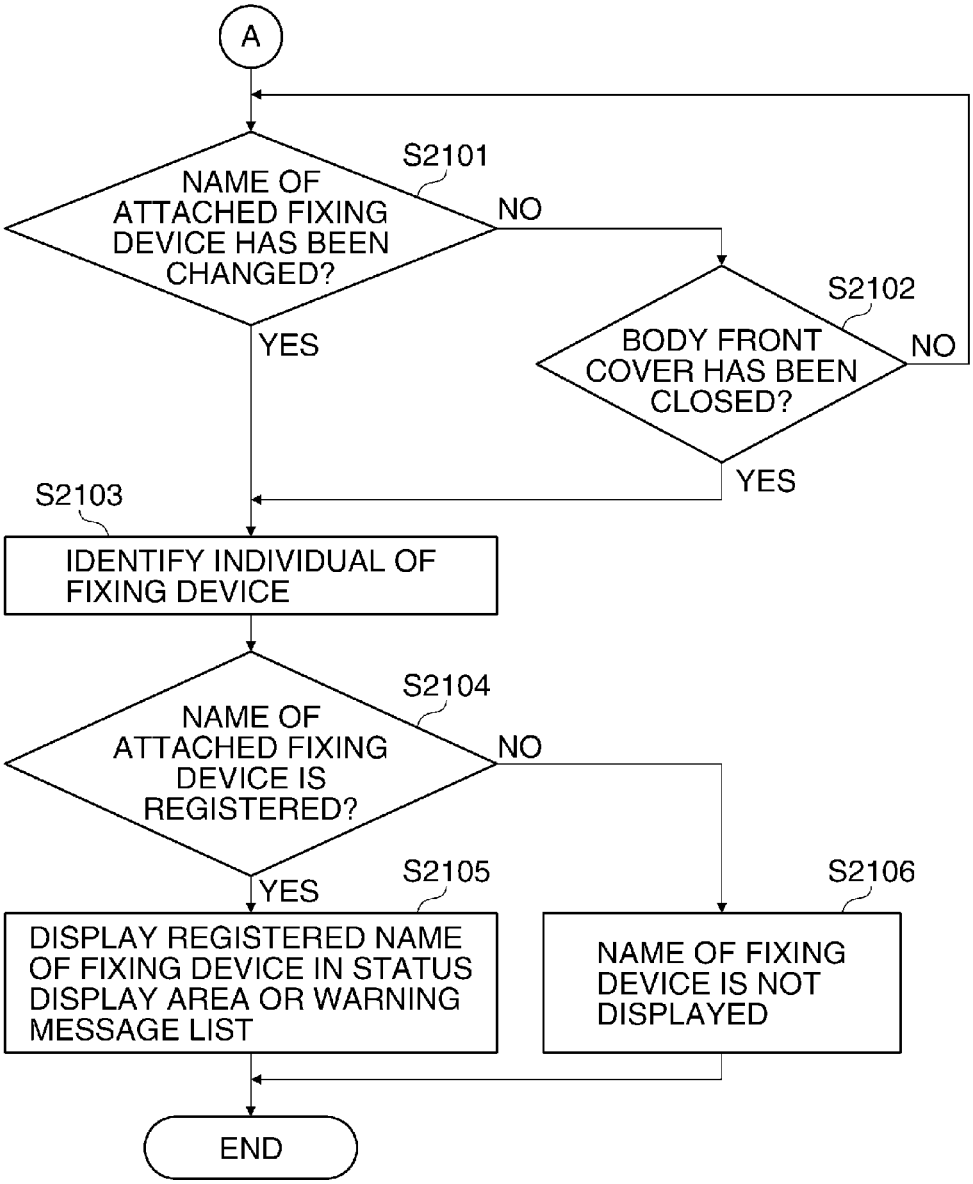
FIG. 21 is a flowchart showing procedures in the second half of the fixing-device-name display process executed in the multifunctional peripheral device according to the fourth embodiment of the present invention.

FIG. 20 is a flowchart showing procedures in the first half of a fixing-device-name display process executed when the multifunctional peripheral device according to the fourth embodiment of the present invention is started or returns from a power-saving mode. FIG. 21 is a flowchart showing procedures in the second half of the fixing-device-name display process.

When the power of the multifunctional peripheral device is turned ON and the multifunctional peripheral device is started, the fixing-device identifying module 702 obtains the ID written in the fixing-device identifying device 312 of the fixing device attached to the multifunctional peripheral device, and identifies the individual of the fixing device (step S2001).

Similarly, when the multifunctional peripheral device returns from the power-saving mode, the fixing-device identifying module 702 obtains the ID of the fixing device attached to the multifunctional peripheral device in the step S2001, and identifies the individual of the fixing device.

Next, the fixing-device-name management module 1804 reads the attribute data corresponding to the ID of the fixing device from the fixing-device attribute 705. Then, the fixing-device-name management module 1804 determines whether a name of the fixing device is registered in the read attribute data (step S2002).

When the name of the fixing device attached to the multifunctional peripheral device is registered (YES in the step S2002), the fixing-device-name management module 1804 displays the registered name of the fixing device on the operation unit 120 (step S2003) by the display control module 706, and proceeds with the process to step S2101 in FIG. 21. For example, the message "Envelope-dedicated fixing device is attached" is displayed on the operation unit 120. Here, the fixing-device-name management module 1804 displays the name in the status display area 1701 or the warning message list 1702.

On the other hand, when the name of the fixing device attached to the multifunctional peripheral device is not registered (NO in the step S2002), the fixing-device-name management module 1804 proceeds with the process to the step S2101 in FIG. 21 without displaying the name of the attached fixing device (step S2004) because there is no particular necessity to attract operator's attention.

In the step S2101, the fixing-device-renaming detection module 1805 determines whether the name of the fixing device attached to the multifunctional peripheral device has been changed. Here, when the fixing-device-name registration module 1803 stores the name of the fixing device attached to the multifunctional peripheral device as the fixing-device attribute 705, the fixing-device-renaming detection module 1805 determines that the name of the fixing device attached to the multifunctional peripheral device has been changed.

When the name of the fixing device attached to the multifunctional peripheral device has been changed (YES in the step S2101), the fixing-device-name management module 1804 proceeds with the process to step S2103.

On the other hand, when the name of the fixing device attached to the multifunctional peripheral device has not been changed (NO in the step S2101), the cover opening/closing detection module 1801 determines whether the body front cover 315 has been closed according to the opening/closing signal received from the cover opening/closing sensor 314 (whether the fixing device has been locked by a locking means) (step S2102).

When the name of the fixing device attached to the multifunctional peripheral device has not been changed and the body front cover 315 is not closed (NO in the step S2102), the process returns to the step S2101. On the other hand, when the body front cover 315 is closed (YES in the step S2102), the fixing-device-name management module 1804 proceeds with the process to the step S2103. Since the process from the steps S2103 through S2106 is identical to the process in the steps S2001 through S2004 in FIG. 21, its description is omitted.

In the fourth embodiment of the present invention, when the name of the fixing device attached to the multifunctional peripheral device is changed, the changed name of the fixing device will be displayed immediately on the operation unit 120 in this way. This enables an operator to be notified of the name of the fixing device attached to the multifunctional peripheral device even if there is no mechanism to detect exchange of fixing devices.

According to the embodiments of the present invention, since a message is displayed so as not to erroneously use a printing sheet unsuitable for the fixing device attached to the multifunctional peripheral device 1000, a plurality of detachable fixing devices are appropriately managed according to usages etc.

The above-mentioned description makes it clear that the operation unit 120 shown in FIG. 2 functions as the receiving unit, that the RAM 113 or the external memory 31 functions as the storage unit, and that the fixing-device identifying module 702 shown in FIG. 8, FIG. 12, FIG. 14, and FIG. 19 functions as the obtaining unit. Moreover, the fixing-device-wise message management module 704 shown in FIG. 8, the fixing-device-wise attribute management module 1102 shown in FIG. 12 and FIG. 14, the fixing-device-name management module 1804 shown in FIG. 19, and the display control module 706 function as the display control unit.

Although the embodiments of the present invention have been described, the present invention is not limited to the above-mentioned embodiments, the present invention includes various modifications as long as the concept of the invention is not deviated.

For example, the functions of the above mentioned embodiments may be achieved as a control method that is executed by an image forming apparatus. Moreover, the functions of the above mentioned embodiments may be achieved as a control program that is executed by a computer with which the image forming apparatus is provided. It should be noted that the control program is recorded into a computer-readable storage medium, for example.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Applications No. 2014-152912, filed Jul. 28, 2014, and No. 2015-021267, filed Feb. 5, 2015, which are hereby incorporated by reference herein in their entireties.

What is claimed is:

1. An image forming apparatus comprising:

a main apparatus having an image forming unit configured to form an image on a recording material, a storage unit configured to store information, an obtaining unit configured to obtain information, a display unit, a first display control unit configured to display an input screen, through which a character string is input, on said display unit, a writing unit configured to write information in said storage unit, and a second display control unit configured to display information on said display unit; and a fixing device, detachably attached to said main apparatus, configured to fix the image formed on the recording material by said image forming unit, wherein said obtaining unit is configured to obtain identification information for discriminating from another fixing device that is exchangeable with said fixing device and capable of being attached to said main apparatus, from said fixing device, said writing unit is configured to write the character string, that is input through the input screen displayed on said display unit by said first display control unit, in said storage unit in association with the identification information obtained by said obtaining unit, and said second display control unit is configured to display, on said display unit as a name of said fixing device, the character string stored in said storage unit in association with the identification information obtained by said obtaining unit.

2. The image forming apparatus according to claim 1, wherein said obtaining unit is configured to obtain the identification information in response to power being supplied to said image forming apparatus.

3. The image forming apparatus according to claim 1, further comprising a third display control unit configured to display, on said display unit, another input screen through which a size of the recording material, that is designated from among recording materials usable with said fixing device and that is permitted to be fixed by said fixing device, is input, wherein said storage unit is configured to further store information corresponding to the size of the recording material input through the another input screen displayed on said display unit by said third display control unit, in association with the identification information.

4. The image forming apparatus according to claim 3, further comprising a control unit configured to permit said image forming unit to form the image on the recording material having a size indicated by the information corresponding to the size of the recording material stored in said storage unit, and inhibit said image forming unit from forming the image on the recording material having a size less than the size indicated by the information corresponding to the size of the recording material stored in said storage unit.

5. The image forming apparatus according to claim 1, wherein said fixing device includes a fixing-storage unit configured to store the identification information.

6. The image forming apparatus according to claim 1, wherein said fixing device includes a fixing-storage unit configured to store the identification information, said fixing-storage unit is configured to store information indicating a kind of the recording material that is permitted to be subjected to fixing by said fixing device, the kind of the recording material including an envelope, and the another fixing device comprises another fixing-storage unit configured to store information indicating a kind of the recording material that is permitted to be subjected to fixing by the another fixing device, the kind of the recording material excluding the envelope.

7. An image forming apparatus comprising:

a main apparatus having an image forming unit configured to form an image on a recording material, a storage unit configured to store information, an obtaining unit configured to obtain information, a display unit, a first display control unit configured to display an input screen, through which a character string is input, on said display unit, a writing unit configured to write information in said storage unit, and a second display control unit configured to display information on said display unit; and a fixing device, detachably attached to said main apparatus, configured to fix the image formed on the recording material by said image forming unit, wherein said obtaining unit is configured to obtain identification information for discriminating from another fixing device that is exchangeable with said fixing unit and capable of being attached to said main apparatus, from said fixing device, said writing unit is configured to write the character string, that is input through the input screen displayed on said display unit by said first display control unit, in said storage unit in association with the identification information obtained by said obtaining unit, and said second display control unit is configured to display, on said display unit as a message related to said fixing device, the character string stored in said storage unit in association with the identification information obtained by said obtaining unit.

8. The image forming apparatus according to claim 7, wherein said obtaining unit is configured to obtain the identification information in response to power being supplied to said image forming apparatus.

9. The image forming apparatus according to claim 7, further comprising a third display control unit configured to display, on said display unit, another input screen through which a size of the recording material, that is designated from among recording materials usable with said fixing device and that is permitted to be fixed by said fixing device, is input, wherein said storage unit is configured to further store information corresponding to the size of the recording material input through the another input screen displayed on said display unit by said third display control unit, in association with the identification information.

10. The image forming apparatus according to claim 9, further comprising a control unit configured to permit said image forming unit to form the image on the recording material having a size indicated by the information corresponding to the size of the recording material stored in said storage unit, and inhibit said image forming unit from forming the image on the recording material having a size less than the size indicated by the information corresponding to the size of the recording material stored in said storage unit.

11. The image forming apparatus according to claim 7, wherein said fixing device includes a fixing-storage unit configured to store the identification information.

12. The image forming apparatus according to claim 7, wherein said fixing unit includes a fixing-storage unit configured to store the identification information, said fixing-storage unit is configured to store information indicating a kind of the recording material that is permitted to be subjected to fixing by said fixing device, the kind of the recording material including an envelope, and the another fixing device comprises another fixing-storage unit configured to store information indicating that a kind of the material that is permitted to be subjected to fixing by the another fixing device, the kind of the recording material excluding the envelope.

* * * * *